US008586848B2

(12) United States Patent
Sasaki

(10) Patent No.: US 8,586,848 B2
(45) Date of Patent: Nov. 19, 2013

(54) MUSICAL-SCORE INFORMATION GENERATING APPARATUS, MUSIC-TONE GENERATION CONTROLLING APPARATUS, MUSICAL-SCORE INFORMATION GENERATING METHOD, AND MUSIC-TONE GENERATION CONTROLLING METHOD

(75) Inventor: Hiroyuki Sasaki, Ome (JP)

(73) Assignee: Casio Computer Co., Ltd., Tokyo (JP)

( * ) Notice: Subject to any disclaimer, the term of this patent is extended or adjusted under 35 U.S.C. 154(b) by 102 days.

(21) Appl. No.: 13/412,097

(22) Filed: Mar. 5, 2012

(65) Prior Publication Data

US 2012/0227571 A1 Sep. 13, 2012

(30) Foreign Application Priority Data

Mar. 7, 2011 (JP) ..... 2011-048524
Mar. 7, 2011 (JP) ..... 2011-048525
Apr. 5, 2011 (JP) ..... 2011-083430
Jul. 8, 2011 (JP) ..... 2011-151390

(51) Int. Cl.
*G10H 1/00* (2006.01)

(52) U.S. Cl.
USPC ..... 84/609; 84/649; 84/600

(58) Field of Classification Search
USPC ..... 84/600–602, 609, 649
See application file for complete search history.

(56) References Cited

U.S. PATENT DOCUMENTS

| | | | | |
|---|---|---|---|---|
| 5,315,911 | A | 5/1994 | Ochi | |
| 7,703,014 | B2 * | 4/2010 | Funaki | 715/269 |
| 2002/0118562 | A1 * | 8/2002 | Hiratsuka | 365/1 |
| 2004/0069115 | A1 * | 4/2004 | Hiratsuka et al. | 84/483.1 |
| 2004/0112201 | A1 * | 6/2004 | Funaki | 84/477 R |
| 2004/0244567 | A1 * | 12/2004 | Asakura | 84/613 |
| 2005/0016361 | A1 * | 1/2005 | Ikeya et al. | 84/602 |
| 2006/0219089 | A1 * | 10/2006 | Funaki et al. | 84/611 |
| 2007/0068369 | A1 * | 3/2007 | Ito et al. | 84/616 |
| 2009/0202106 | A1 * | 8/2009 | Hong et al. | 382/100 |
| 2011/0239845 | A1 * | 10/2011 | Gregson | 84/477 R |
| 2012/0227571 | A1 * | 9/2012 | Sasaki | 84/477 R |

FOREIGN PATENT DOCUMENTS

| | | | |
|---|---|---|---|
| JP | 10-240117 | A | 9/1998 |
| JP | 3077269 | B2 | 6/2000 |

* cited by examiner

*Primary Examiner* — David S. Warren
(74) *Attorney, Agent, or Firm* — Holtz, Holtz, Goodman & Chick, PC

(57) ABSTRACT

A musical score extracting unit specifies areas of each of measures and the measure number of each measure on a musical score based on positions of musical-score composing elements such as part lines, staffs and bar lines. A music-data dividing unit divides music-data file based on time information in the music-data file to generate plural unit music-data files containing pitch information and time information for one measure. The music-data dividing unit specifies measures where repeat marks are placed based on sorts and positions of the repeat marks and positions of the part lines, staffs and bar lines on the musical score, thereby removing unit music-data file to repeat as instructed by the repeat marks from the plural music-data files to obtain a final unit music-data files associated with the respective measure numbers.

19 Claims, 30 Drawing Sheets

MUSICAL-SCORE INFORMATION GENERATING APPARATUS, MUSIC-TONE GENERATION CONTROLLING APPARATUS, MUSICAL-SCORE INFORMATION GENERATING METHOD, AND MUSIC-TONE GENERATION CONTROLLING METHOD

CROSS-REFERENCE TO RELATED APPLICATIONS

The present application is based upon and claims the benefit of priority from the prior Japanese Patent Application No. 2011-48524 and No. 2011-48525, filed Mar. 7, 2011, No. 2011-83430, filed Apr. 5, 2011, and No. 2011-151390, filed Jul. 8, 2011, the entire contents of which are incorporated herein by reference.

BACKGROUND OF THE INVENTION

1. Field of the Invention

The present invention relates to a musical-score information generating apparatus, a musical-tone generation controlling apparatus, a musical-score information generating method, and a musical-tone generation controlling method, which control reproduction of a musical piece based on music data, with use of musical-score information that associates musical-score data of a musical score with music data relating to the performance of the musical piece based on the musical score.

2. Description of the Related Art

In electronic musical instruments and music reproducing apparatuses, a technology has been proposed, which displays a musical score of a musical piece on the display screen of a displaying device and generates musical tones corresponding to musical notes indicated on the displayed musical score, thereby giving a performance of the musical piece.

For example, Japanese Patent Gazette No. 3077269 discloses an apparatus, which compares musical score data with performance data generated based on a key of a keyboard pressed by a player, thereby detecting a position on the musical score where the player is playing, and displays the detected position on the musical score.

Further, Japanese Patent No. Hei 10-240117 A discloses an apparatus, which uses MIDI data file, musical-score image data file containing musical-score image data representing a musical score in each of measures, and exercise supporting data containing a controlling code for each of the measures. The controlling code includes a code indicating an appropriate page of the musical score, a corresponding part of MIDI data, and appropriate musical-score image data. In the apparatus, the page of the measure to be learned or practiced is confirmed based on the controlling code, and the musical score containing the measures on the page is displayed.

In general, the musical score contains various repeat symbols or repeat marks and the same measure(s) is repeatedly played for plural times. Meanwhile, music data for giving a performance of a musical piece, such as SMF (Standard Midi File) storing MIDI data, is composed of note-on events, note-off events and time information, wherein the note-on event corresponds to generation of a musical tone, the note-off event corresponds to cease generation of a musical tone, and the time information corresponds to a time duration between the events. But a repetition of the measure (s) is not contained in the music data. Therefore, since musical notes on the musical score do not always correspond to the events in the music data, when a position (for example, a measure) is designated on the musical score, sometimes a music piece cannot be performed smoothly.

Further, since the repeat symbol or the repeat mark is more complex in figure, when compared with other elements composing the musical score, such as a staff and bar lines, a possibility of correctly recognizing the repeat mark in the image data will become low. Therefore, sometimes it is difficult to specify plural repeat marks and their positions on the image of the musical score as the composing elements of the musical score.

The present invention has an object to provide an apparatus and a method, which generate musical score information containing musical score data of a musical score and music data for giving a performance of music based on the musical score, both data being properly associated with each other, and specify repeat marks and their positions on the image of the musical score, and read music data of each of the measures based on the specified repeat marks, thereby reproducing the music properly and giving a performance of the music from the position desired by a user.

SUMMARY OF THE INVENTION

According to one aspect of the invention, there is provided a musical-score information generating apparatus, which comprises a storing unit for storing music data and image data, wherein the music data contains pitch information for indicating a pitch of each of musical tones composing a musical piece and the time information for indicating a timing of generation of each musical tone in the musical piece, and the image data represents an image of a musical score of the musical piece, the musical score having musical-score composing elements such as part lines, staffs, and bar lines; a measure specifying unit for specifying an area of each measure and the measure number of the measure based on positions of the part lines, the staffs and the bar lines on the musical score; a unit music-data generating unit for dividing the music data based on the time information in the music data to generate plural pieces of unit music data each containing time information and pitch information for one measure; a repeat-mark position specifying unit for specifying a measure where a repeat mark is placed, based on a sort and a position of the repeat mark and the positions of the part lines, the staffs and the bar lines on the musical score; a unit music-data obtaining unit for removing overlapping unit music data form the plural pieces of unit music data generated by the unit music-data generating unit to obtain a final pieces of unit music data, and for associating the obtained final pieces of unit music data with the measure numbers respectively to store said final pieces of unit music data in the storing unit; and a musical-score element data generating unit for generating musical-score element data containing positions on the musical score where the part lines, the staffs and the bar lines are placed, and areas and the measure numbers of the measures, and sorts and positions of the repeats marks, and storing the generated musical-score element data in the storing unit.

According to another aspect of the invention, there is provided a musical-tone generation controlling apparatus, which comprises a musical-tone generating unit for generating musical tones composing music; a storing unit for storing image data of a musical score of music, plural pieces of unit music data containing music data, and musical-score element data, wherein the music data contains pitch information indicating a pitch of each of musical tones in a measure and time information indicating a timing of generation of each of musical tones in the measure, and the musical-score element data contains positions of part lines, staffs and bar lines on the musical score, and an area of each of measures and the measure numbers of the measures; a displaying unit for displaying an image of the musical score based on the image data representing the musical score of music; a position detecting unit disposed on top of the displaying unit for detecting a position on the displaying unit where an operation is performed by a user; a position specifying unit for specifying a position on the displayed musical score corresponding to the position detected by the position detecting unit with reference to the musical-score element data stored in the storing unit; and a tone-generation controlling unit for reading from the storing unit a final unit music data corresponding to the position specified on the displayed musical score by the position specifying unit, and for instructing the musical-tone generating unit to generate a musical tone based on music data in the final unit music data read from the storing unit.

According to still another aspect of the invention, there is provided a musical-tone generation controlling apparatus, which comprises a musical-tone generating unit for generating musical tones composing music; a storing unit for storing plural pieces of unit music data and musical-score element data, wherein the plural pieces of unit music data contain music data including the measure number of each of measures, pitch information indicating a pitch of each musical note in each measure, and time information indicating a timing of generation of each musical note in each measure, and the musical-score element data contains the measure numbers and sorts of repeat marks placed in the measures, and further wherein the plural pieces of unit music data include no overlapping unit music data, which is to be repeated based on the sorts and positions of the repeat marks composing the musical score elements; a tone-generation controlling unit for detecting the repeat mark placed in the unit music data containing a musical tone to be generated, with reference to the musical-score element data stored in the storing unit, to determine unit music data to read next based on the detected repeat mark, and for reading the determined unit music data from the storing unit to give the musical-tone generating unit an instruction to generate a musical tone based on music data in the unit music data read from the storing unit.

DETAILED DESCRIPTION OF THE PREFERRED EMBODIMENTS

Figure 1:
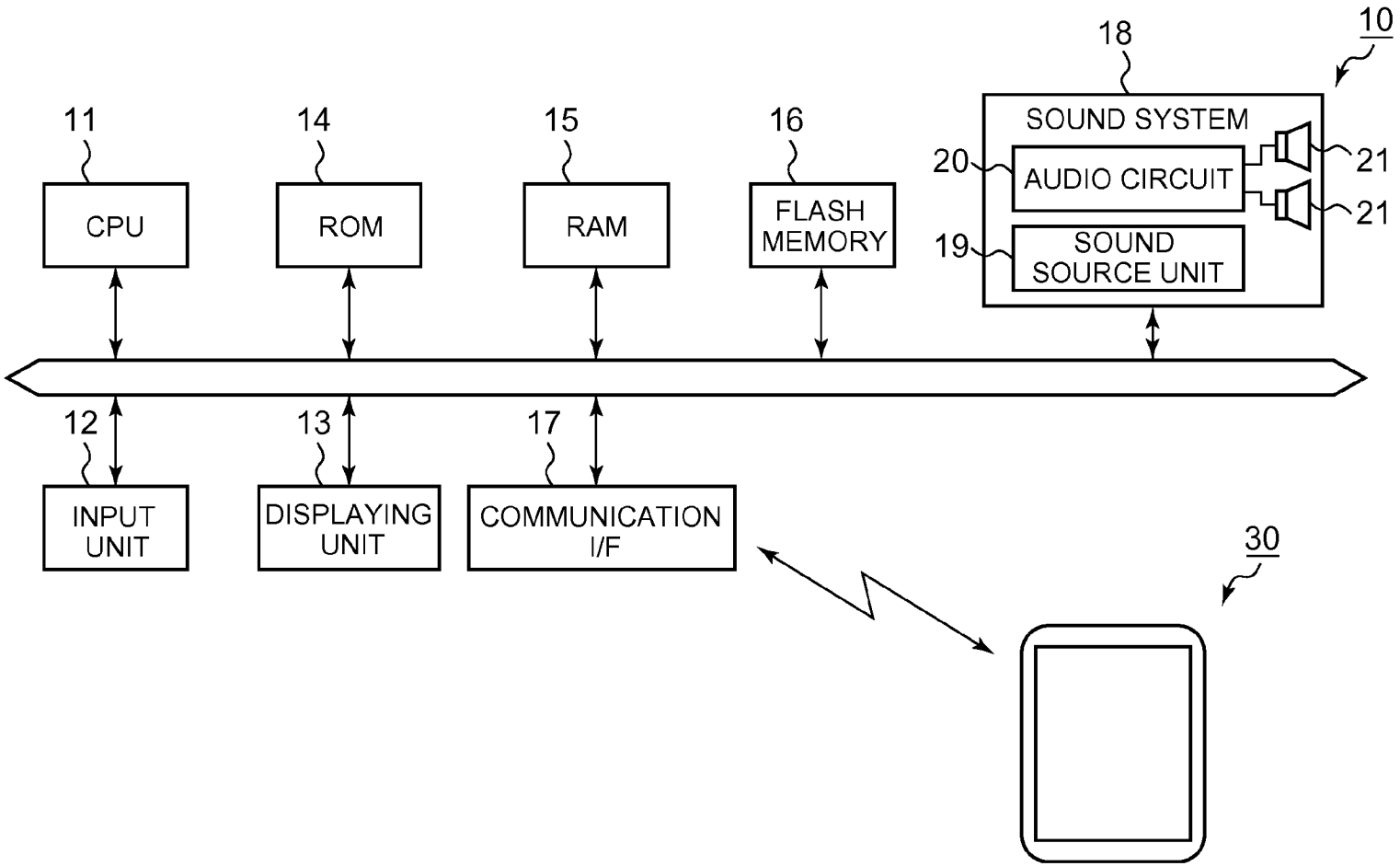
FIG. 1 is a block diagram showing a configuration of a music reproducing system according to the embodiment of the present invention.

Now, embodiments of the present invention will be described in detail with reference to the accompanying drawings. FIG. 1 is a block diagram showing a configuration of a music reproducing system according to the embodiment of the invention. As shown in FIG. 1, the music reproducing system according to the embodiment of the invention comprises a center apparatus 10 and a terminal apparatus 30. The terminal apparatus 30 of in the present embodiment comprises CPU 11, an input unit 12, a displaying unit 13, ROM 14, RAM 15, a flash memory 16, a communication interface (I/F) 17, and a sound system 18. For example, a personal computer and a server can be used as the center apparatus 10.

In the present embodiment of the invention, the center apparatus 10 has music data file containing music data for reproducing a musical piece and musical-score data file containing image data of a musical score of the musical piece, stored in a storing device (for example, in the flash memory 16). The center apparatus 10 generates a musical-score data file, which contains data (musical-score element data) for associating the music data with the image data, and sends the terminal apparatus 31 the generated musical-score data file together with the music data file and the musical-score data file.

CPU 11 reads the musical-score data from the storing device, and executes various processes, such as a process for extracting musical-score elements including the staff and bar lines contained in the musical-score data and a process for dividing musical data into measures with use of the extracted musical-score elements, thereby producing a unit music data file containing music data in measure units. The input unit 12 comprises an input device, including a keyboard and a mouse. The displaying unit 13 has, for example, a liquid crystal displaying device.

ROM 14 serves to store a program, which is read and run by CPU 11 to perform the process for extracting musical-score elements including the staff and bar lines contained in the musical-score data and the process for dividing musical data into plural pieces of data per measure (data per bar) with use of the extracted musical-score elements, thereby producing a unit music data file containing plural pieces of music data per measure (or music data per bar). RAM 15 serves to store the program read from ROM 14 and data produced during the course of the process. Further, music data files containing music data of various pieces of music and musical-score data files of the various pieces of music are recorded in the flash memory 16.

The communication interface 17 serves to controls an operation of sending and/or receiving data through an external network such as the Internet. The sound system 18 comprises a sound source unit 19, an audio circuit 20, and speakers 21.

Figure 2:
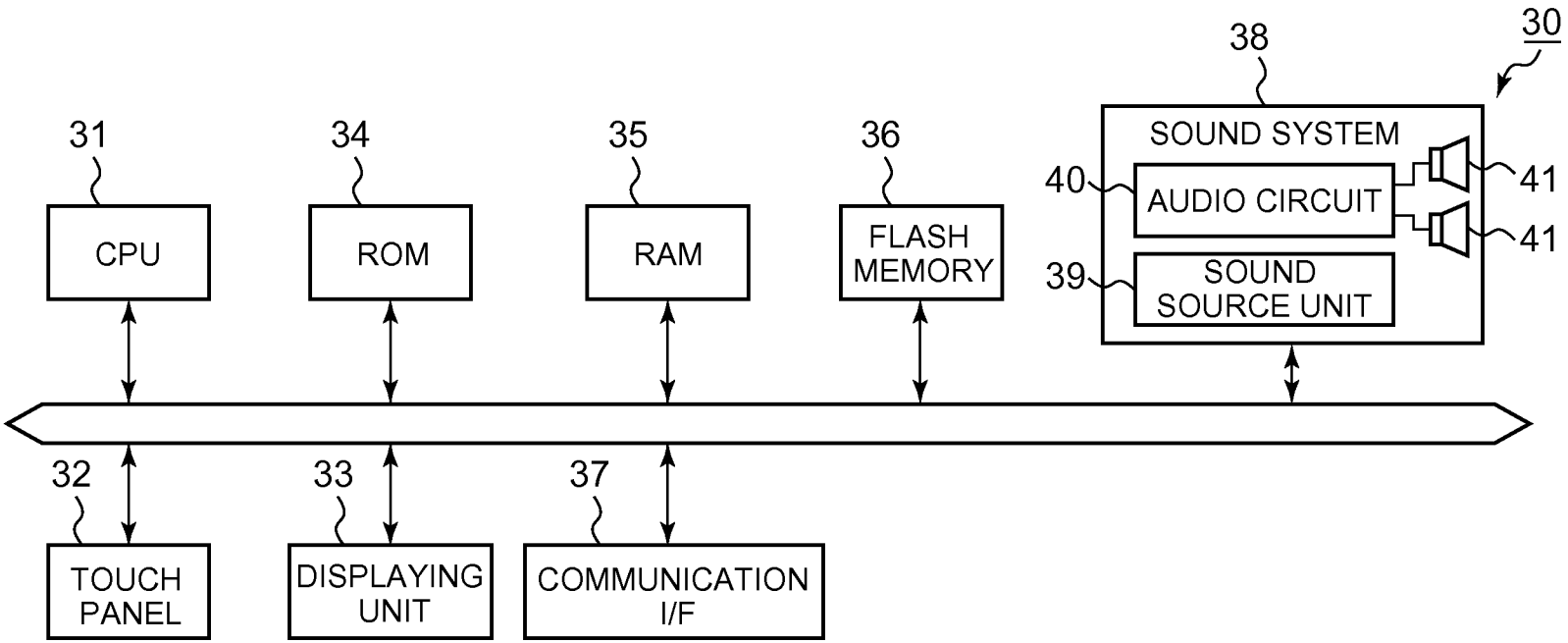
FIG. 2 is a block diagram showing a configuration of a terminal apparatus according to the embodiment of the invention.

FIG. 2 is a block diagram showing a configuration of the terminal apparatus 30 in the embodiment of the invention. The terminal apparatus 30 in the present embodiment comprises CPU 31, a touch panel 32, a displaying unit 33, ROM 34, RAM 35, a flash memory 36, a communication interface (I/F) 37, and a sound system 38. For example, a smart phone can be used as the terminal apparatus 30.

In the present embodiment of the invention, the terminal apparatus 30 receives from the center apparatus 10 the music data file (unit music data file), musical-score data file, and the musical-score element data file, and displays a musical score based on data contained in the received data files, and gives a performance of a musical piece from a designated measure or repeats a designated measure.

CPU 31 performs various processes, including a process of displaying a musical score and icons to be displayed on the displaying screen of the displaying unit 33, a process of detecting a touching operation on the touch panel 32, and a process of performing a musical piece based on the musical-score element data file and the unit music data file. The touch panel 32 is stacked on top of the displaying unit 33 including the liquid crystal displaying device.

ROM 34 serves to store a program for CPU 31 to performs various processes, including the process of displaying a musical score and icons to be displayed on the displaying screen of the displaying unit 33, the process of detecting a touching operation on the touch panel 32, and the process of performing a musical piece based on the musical-score element data file and the unit music data file. RAM 35 serves to store the program read from ROM 34 and data produced during the course of the process. Received musical-score data files, musical-score element data file, and unit music-data files can be recorded in the flash memory 36. The communication interface 37 serves to control an operation of sending and/or receiving data through an external network such as the Internet. The sound system 38 comprises a sound source unit 39, an audio circuit 40, and speakers 41.

Figure 3:
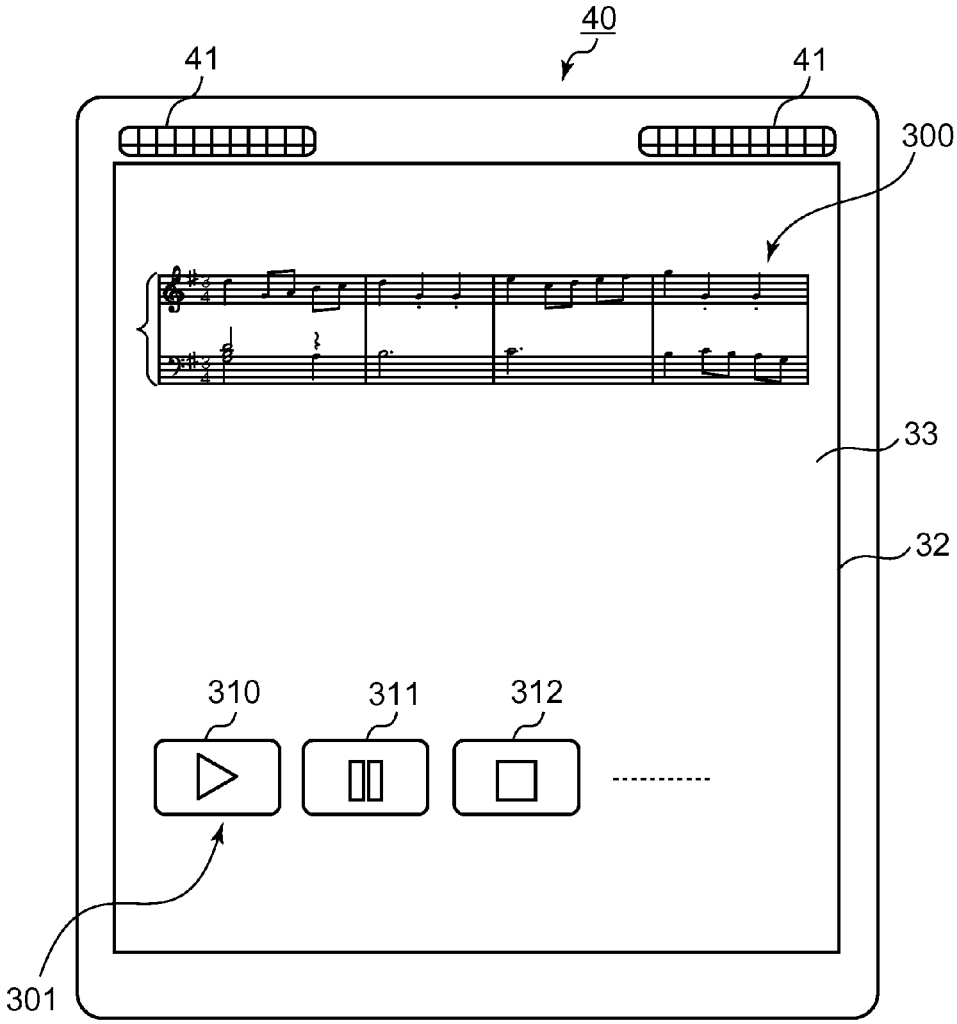
FIG. 3 is a front view illustrating an external appearance of the terminal apparatus according to the embodiment of the invention.

FIG. 3 is a front view showing an external appearance of the terminal apparatus 30 according to the present embodiment of the invention. As shown in FIG. 3, the terminal apparatus 30 is provided with the displaying unit 33 having the liquid crystal displaying device, on top of which the touch panel 32 is stacked. On the displaying screen of the displaying unit 33 are displayed, for example, a musical score 300 and the input unit 301 including various sorts of icons 310 to 312. A user is allowed to designate a desired measure on the musical score by touching on a position on the musical score 300. Further, the user is also allowed to enter a command by touching his or her desired icon.

Figure 4:
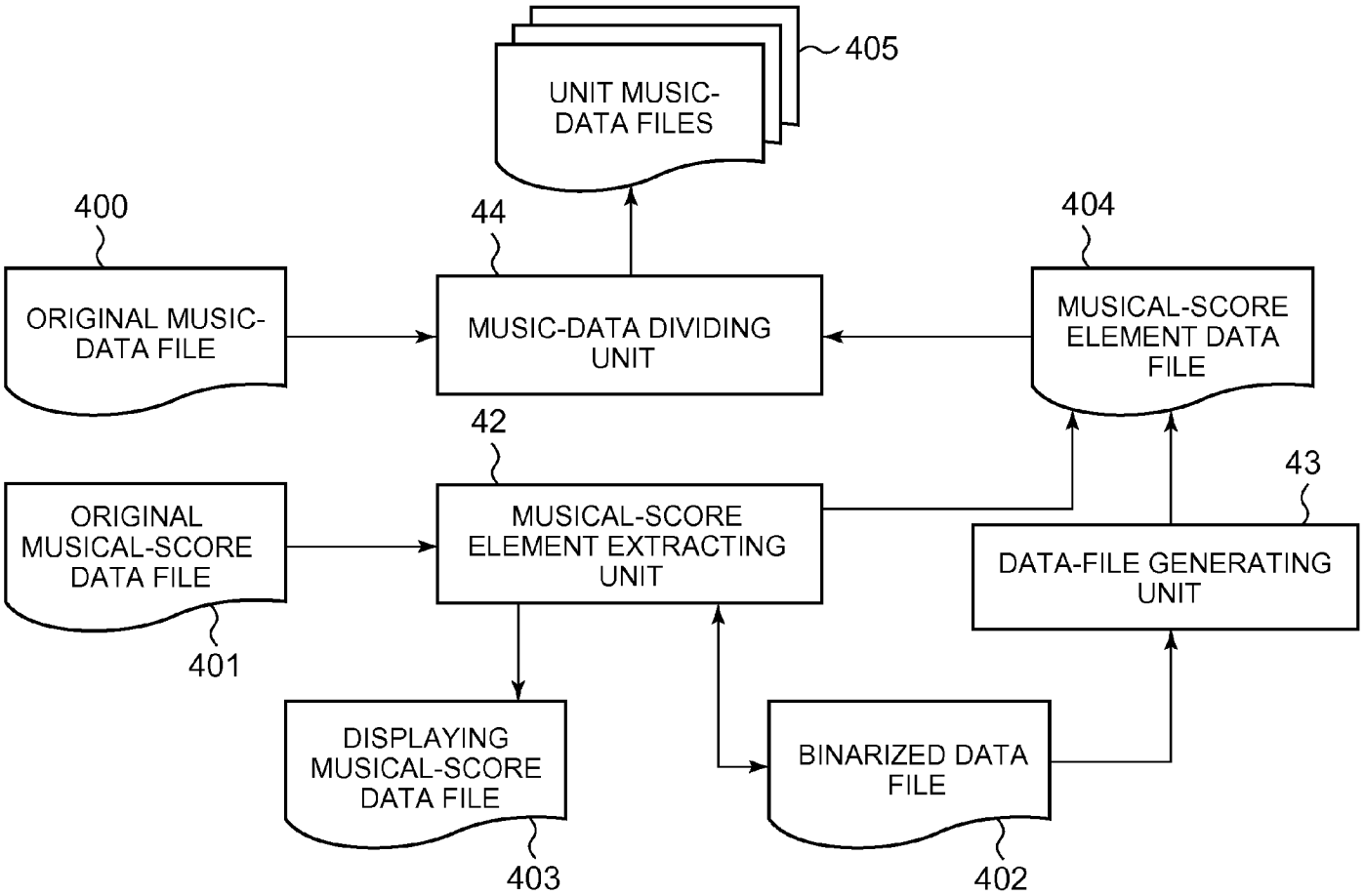
FIG. 4 is a block diagram showing a configuration of functions of a center apparatus according to the embodiment of the invention.

Now, the processes to be performed in the center apparatus 10 will be described. FIG. 4 is a block diagram showing a configuration of functions of the center apparatus 10 according to the present embodiment of the invention. As shown in FIG. 4, the center apparatus 10 has a musical-score element extracting unit 42, a data-file generating unit 43, and a music-data dividing unit 44. In the present embodiment of the invention, the flash memory 16 of the center apparatus 10 stores an original music-data file 400 containing music data of a musical piece, that is, original music data and an original musical-score data file 401 containing musical-score data of a musical piece, that is, original musical-score data.

The original music-data file 400 is a so-called standard MIDI file (SMF), and contains time information (delta time) indicating time intervals between events including generation of musical tones and information indicating sorts of events such as note-on events and note-off events. The original musical-score data file 401 is an image data file in a known format, such as PDF file.

The musical-score element extracting unit 42 reads the original musical-score data file 401 to generate a displaying musical-score data file 403 to be sent to the terminal apparatus 30. The displaying musical-score data file 403 is, for example, PNG (Portable Network Graphic) file. Of course, the displaying musical-score data file 403 can be image data in a format other than PNG file. The musical-score element extracting unit 42 performs a binarization-process on the original musical-score data file 401 to generate a bit-mapped binarized data file 402.

The musical-score element extracting unit 42 refers to the binarized data file 402 to extract elements of the musical score such as the staff, part lines and bar lines on the musical score. In the present embodiment of the invention, the elements of the musical score involve lines for defining time intervals and parts on the musical score, such as the staff, part lines and bar lines on the musical score, and repeat marks. But musical notes for directly composing a musical piece are not involved in the elements of the musical score.

The musical-score element extracting unit 42 obtains coordinate data of the extracted element on the musical score. With use of the information obtained by the musical-score element extracting unit 42, the data-file generating unit 43 generates musical-score element data file 404 containing information for specifying sorts of musical-score elements and their positions. The generated displaying musical-score data file 403, binarized data file 402, and musical-score element data file 404 are stored, for example, in the flash memory 16.

Further, with use of music data in the original music-data file 400 and musical-score element data in the musical-score element data file 404, the music-data dividing unit 44 divides the music data into plural pieces of unit music data per measure (or per bar) and removes overlapping data yielded due to the repeat marks, thereby generating a predetermined unit music data file 405. The unit music data file 405 is also stored in the flash memory 16.

Figure 5:
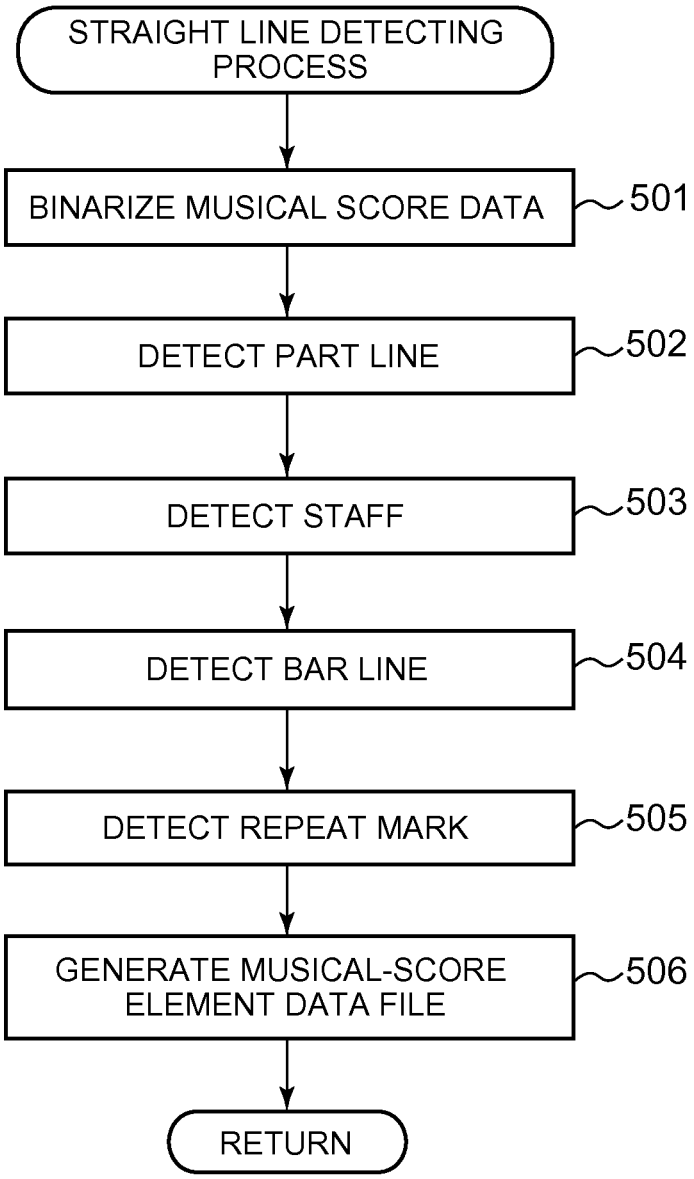
FIG. 5 is a flow chart showing an example of a process (straight-line detecting process) to be performed by a musical-score element extracting unit in the embodiment of the invention.

The functions of the musical-score element extracting unit 42, the data-file generating unit 43 and the music-data dividing unit 44 are realized mainly by CPU 11 shown in FIG. 1. Hereinafter, the processes performed by these units 42 to 44 will be described in detail. FIG. 5 is a flow chart showing an example of the process (straight line detecting process) to be performed by the musical-score element extracting unit 42 according to the embodiment of the invention. The musical-score element extracting unit 42 binarizes the original musical-score data and stores a binarized data-file containing the binarized data in RAM 15 (step 501). For example, the binarized data is bit-mapped data. In the case where the original musical-score data file is a binarized data file, the process of step 501 will be performed and will be omitted.

Figure 6:
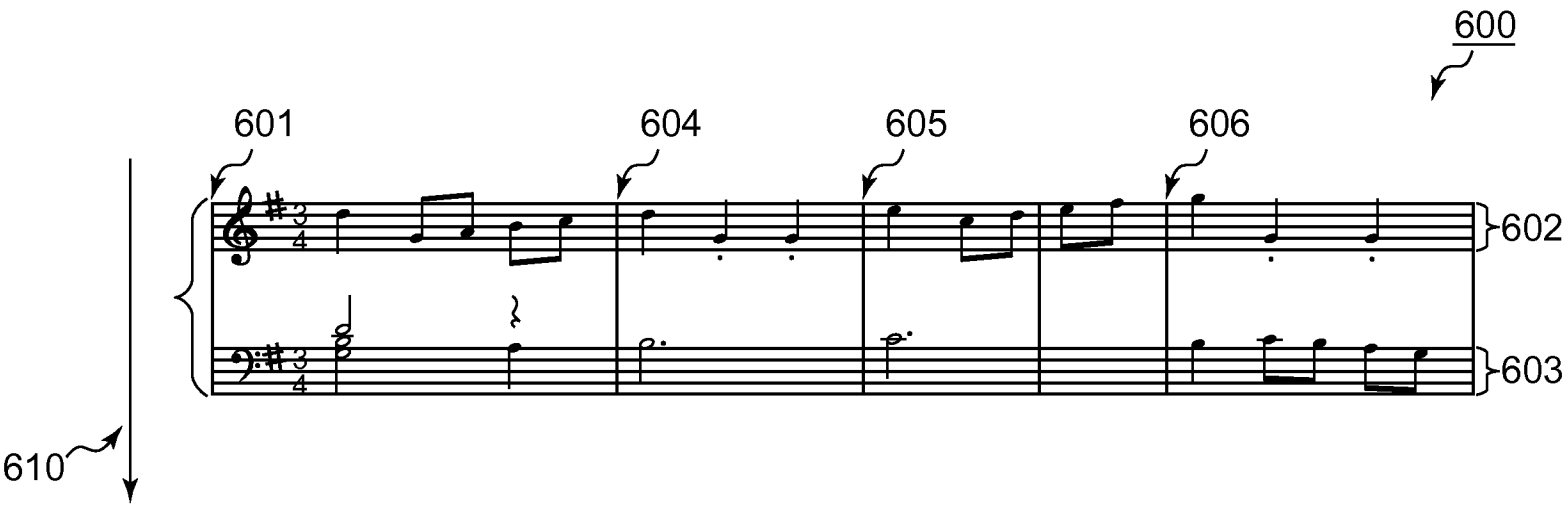
FIG. 6 is a view showing an example of a musical score represented by musical-score data.

The musical-score element extracting unit 42 detects a part line from the binarized data (step 502). The part line is called a "single vertical line", too. FIG. 6 is a view showing an example of a musical score represented by the musical-score data. The part line is used to connect portions on the musical score to be played simultaneously, and defines staves on the musical score. In general, the part line is drawn to the left of multiple staffs on the musical score. In FIG. 6, a reference numeral 601 denotes the part line. An example of a grand staff with the part line is shown in FIG. 6. On the musical score, multiple staffs are connected at their beginning positions by the part line 601.

Figure 7:
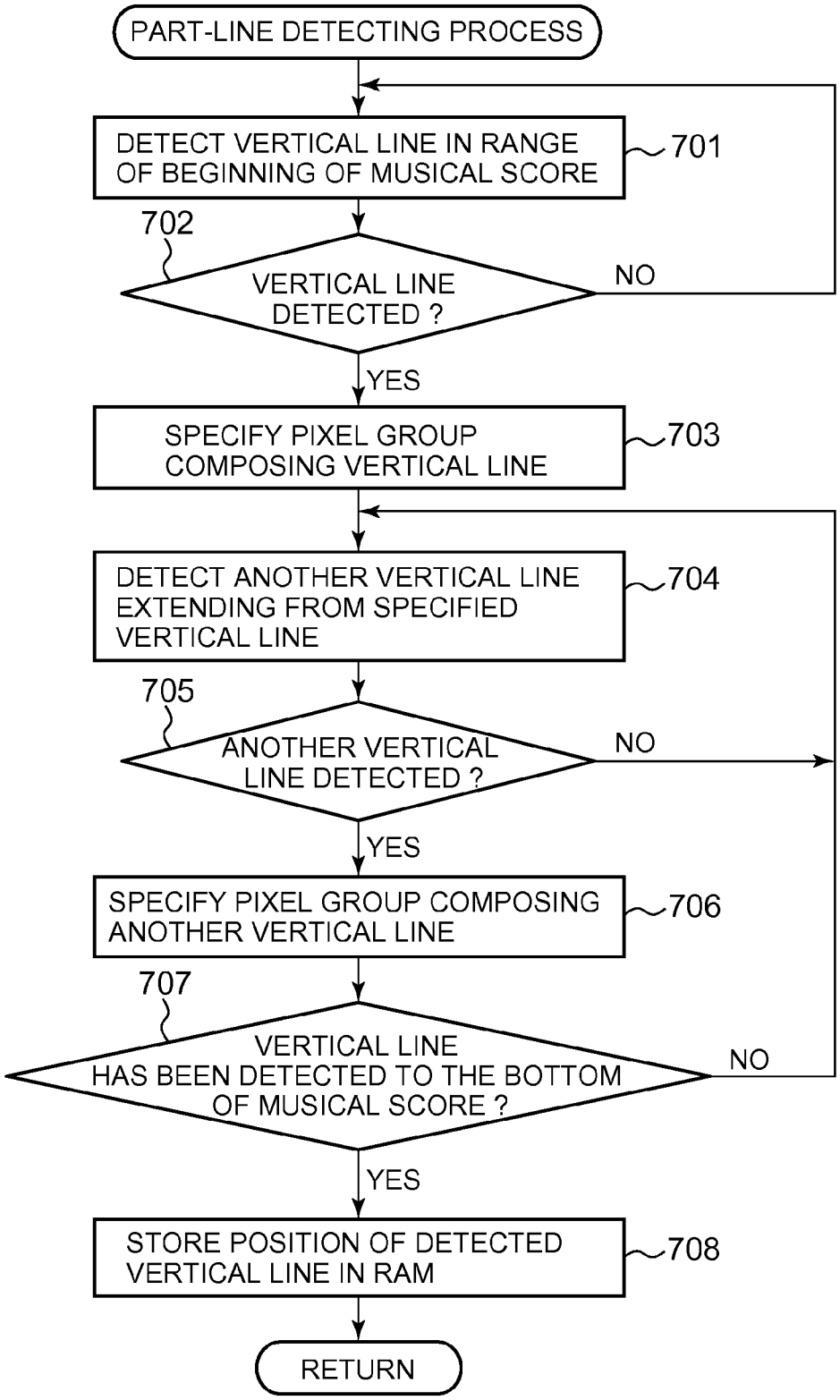
FIG. 7 is a flow chart showing a detailed process (part-line detecting process) to be performed at step 502 in FIG. 5.

FIG. 7 is a flow chart showing the detailed process (part-line detecting process) to be performed at step 502 in FIG. 5. The musical-score element extracting unit 42 detects a vertical line, which is composed of more than the predetermined number of successive pixels, in a range of the beginning of the musical score in a musical score image (step 701). When the vertical line has been detected (YES at step 702), the musical-score element extracting unit 42 specifies the pixel group composing the vertical line (step 703). Further, the musical-score element extracting unit 42 detects another vertical line, which is composed of more than the predetermined number of successive pixels, with reference to pixels disposed downward from the specified vertical line (step 704).

When the another vertical line has been detected (YES at step 705), the musical-score element extracting unit 42 specifies the pixel group composing the another vertical line (step 706). Referring to position information of the pixel groups stored in RAM 15, the musical-score element extracting unit 42 can specify the pixel group. The musical-score element extracting unit 42 judges whether or not the vertical line has been detected to the bottom of the musical score image (step 707). When it is determined NO at step 707, the musical-score element extracting unit 42 returns to step 704. Meanwhile, it is determined YES at step 707, the musical-score element extracting unit 42 stores position information (coordinate) of the detected vertical line in RAM 15 (step 708) and finishes the detecting process of the part line.

In the part-line detecting process, the part line 601, that is, a vertical line placed to the left on the musical score is detected in FIG. 6. Further, a line extending downward from the detected part line 601 (refer to Reference numeral: 610) is also detected (not shown in FIG. 6).

Figure 8:
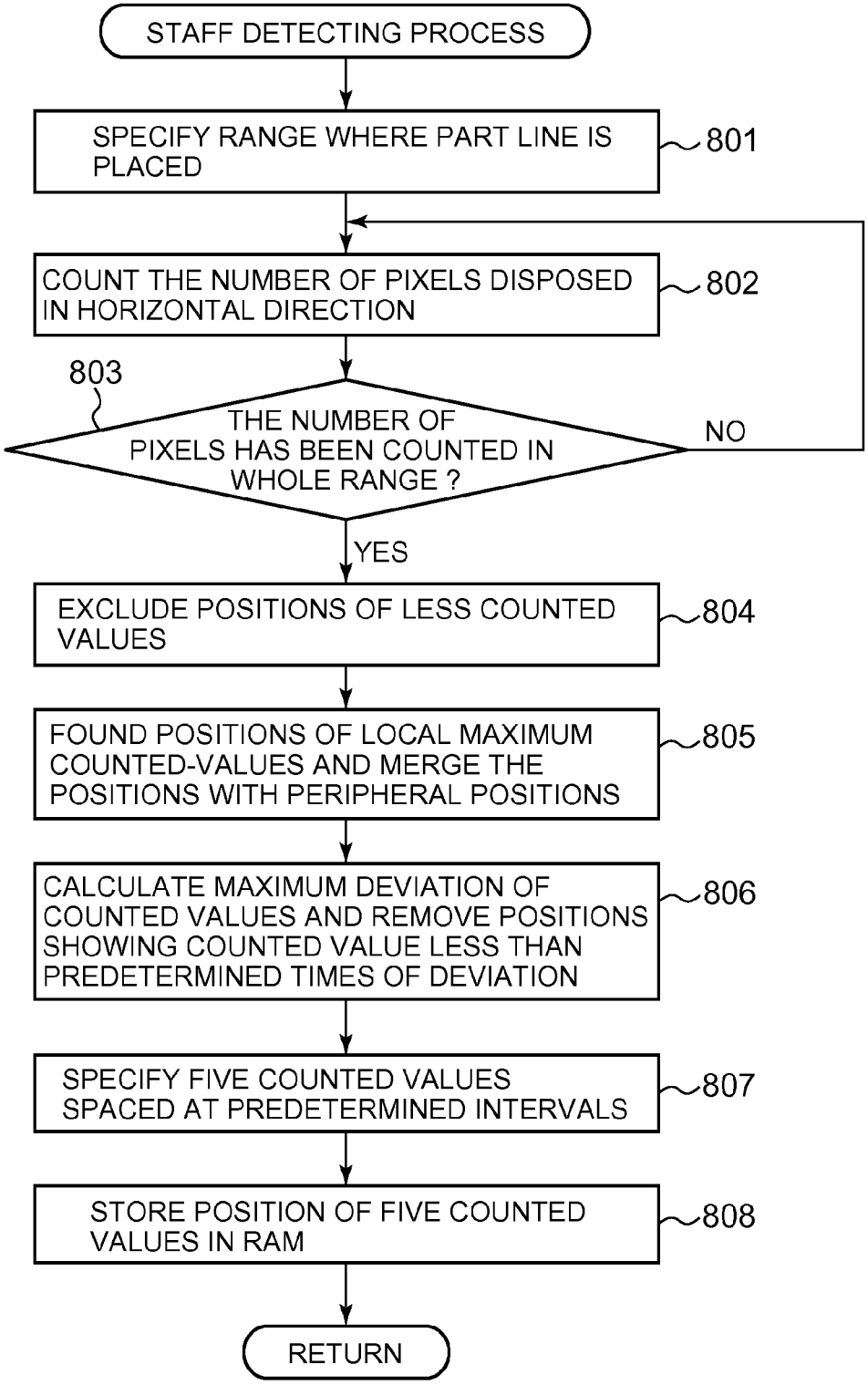
FIG. 8 is a flow chart showing a detailed process (five-stave-line detecting process) to be performed at step 503 in FIG. 5.

After finishing the part-line detecting process, the musical-score element extracting unit 42 detects the staff on the musical score (step 503 in FIG. 5). FIG. 8 is a flow chart showing the detailed process (staff detecting process) to be performed at step 503 in FIG. 5. The musical-score element extracting unit 42 specifies a range, in which the part line is placed in the vertical direction (step 801). The musical-score element extracting unit 42 counts the number of pixels corresponding to black points disposed in the horizontal direction within the range specified at step 801 (step 802). The musical-score element extracting unit 42 judges whether or not the number of pixels has been counted in the whole range, in which the part line is placed (step 803). When it is determined NO at step 803, the musical-score element extracting unit 42 returns to step 802.

Figure 9:
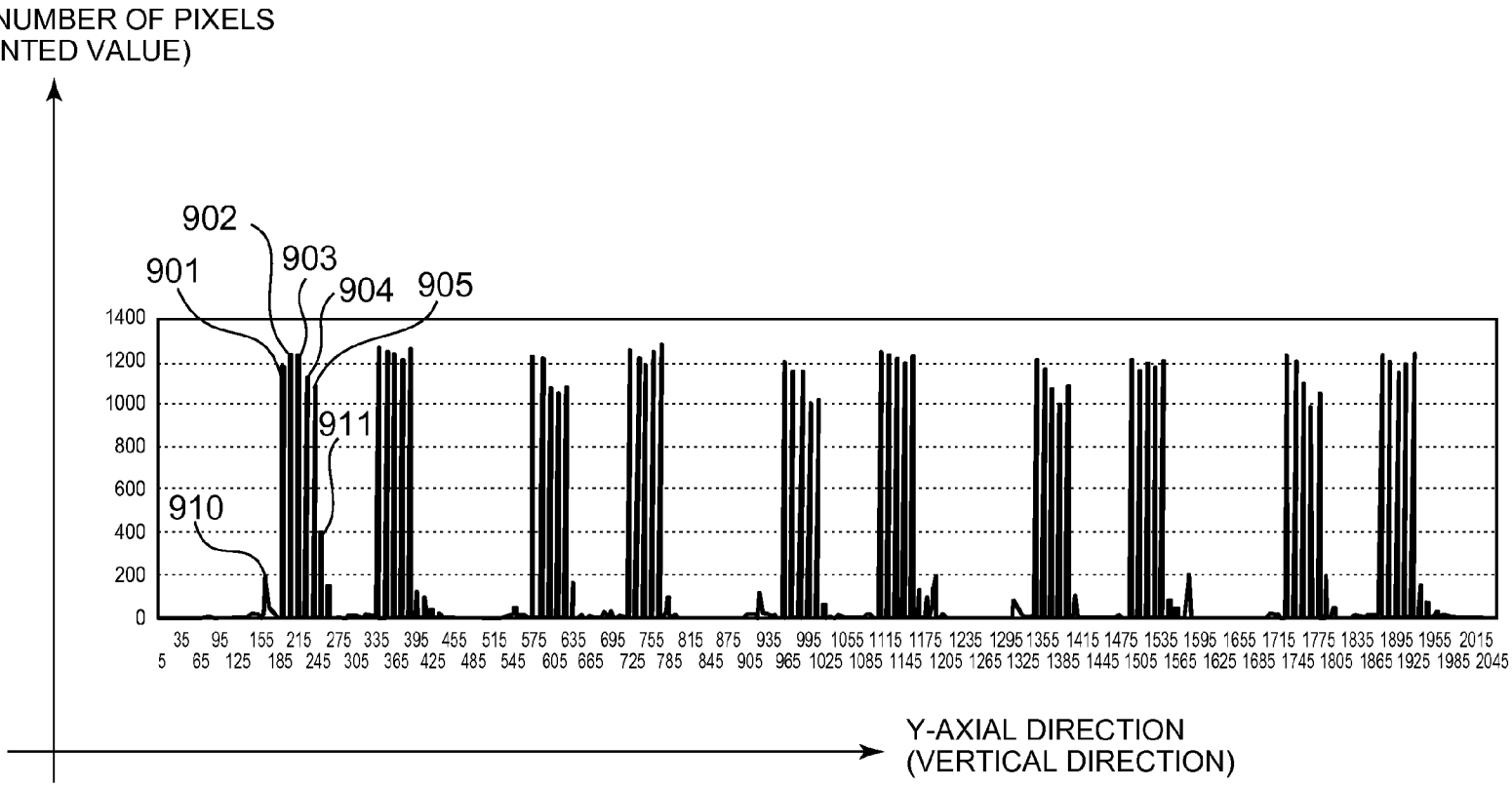
FIG. 9 is a view showing a graph indicating the number of pixels along the y-coordinate.

In the process at step 802, values (pixel values) of respective pixels having the same y-coordinate in every coordinate in a y-axial direction (vertical direction) are referred in the range, in which the part line is placed, and when such pixel values indicate the black points, then a counter is incremented. In this manner, the number of pixels corresponding to the black points in an x-axial direction (horizontal direction) is counted by the counter with respect to each y-coordinate in the range, in which the part line is placed. FIG. 9 is a view showing a graph indicating the number of pixels along the y-coordinate. In the graph shown in FIG. 9, the horizontal axis indicates positions in the y-axial direction in the musical score and the vertical direction indicates the number of pixels (counted value).

As will be understood from the musical score shown in FIG. 6, five straight lines (the first line to the fifth line) composing the staff (602, 603) with even spaces between them are drawn in the horizontal direction. Therefore, the numbers (counted value) of pixels at positions corresponding to the straight lines are extremely large compared with those at other positions. In the example shown in FIG. 9, the numbers (counted values) of pixels (901 to 905) disposed at five evenly separated positions are extremely larger than those (910, 911) at the other positions. In the present embodiment, five evenly separated positions, at which the numbers of pixels are extremely larger than other are detected, and it is determined that the detected positions correspond to the position of the staff. To detect the position of the staff, processes are performed at step 804 and the following steps in FIG. 8.

The musical-score element extracting unit 42 excludes positions showing the counted values, the rate of which to the maximum counted-value is less than a predetermined rate, for example, 20%, from the possible positions of the staff (step 804). Then, the musical-score element extracting unit 42 founds local maximum counted-values and merges these positions showing the local maximum counted-values and their peripheral positions into one position (step 805). At step 805, these peripheral positions are considered as the same position and are assigned with the local maximum counted-value. The musical-score element extracting unit 42 calculates the maximum deviation "σ" of the counted values and removes positions showing the counted values that are not a predetermined times (for example, 3 times) larger than "σ"

from the possible positions of the staff (step 806). The musical-score element extracting unit 42 specifies five counted values spaced at certain intervals with exception of the positions removed from the possible positions (step 807). The five positions of the specified counted values will be the position of the staff. The musical-score element extracting unit 42 stores information of the position of the staff in RAM 15 (step 808).

Figure 10:
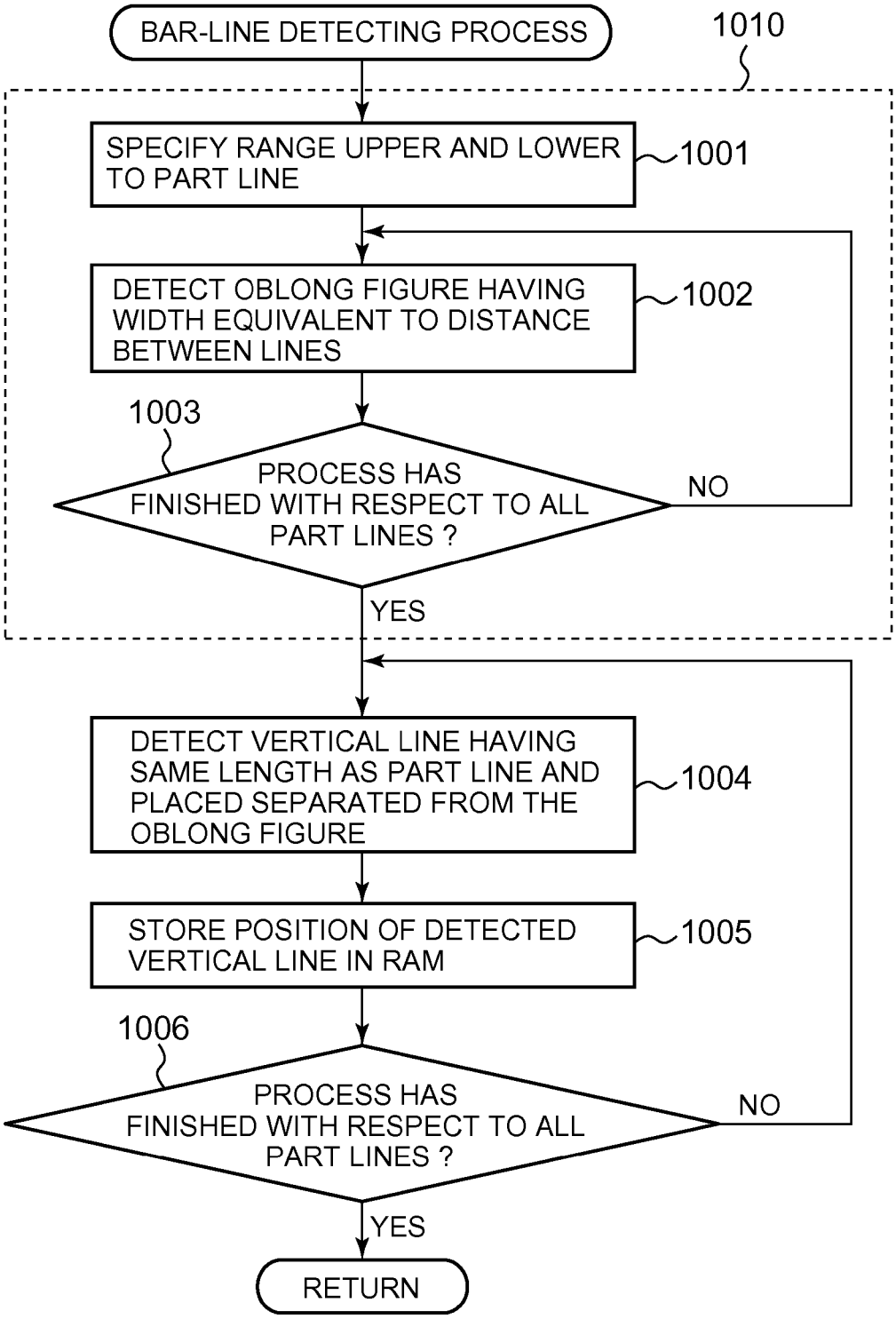
FIG. 10 is a flow chart of an example of a detailed process (bar-line detecting process) to be performed at step 504 in FIG. 5.

When the five-stave-line detecting process has finished, the musical-score element extracting unit 42 detects bar lines on the musical score (step 504). FIG. 10 is a flow chart of an example of a detailed process (bar-line detecting process) to be performed at step 504. The bar lines are vertical lines on the musical score and have the same length as the part line. The bar lines are used to separate measures and placed between the measures (Refer to Reference numerals: 604 to 696 in FIG. 6). The musical-score element extracting unit 42 detects a musical note placed on a line or between lines on the staff musical score (Refer to Reference numeral: 1010).

More specifically, the musical-score element extracting unit 42 specifies a rectangle range containing the part line and the upper and lower portions to the part line of on the musical score (step 1001). The specified range will substantially correspond to an area, in which musical notes seem to be placed. The musical-score element extracting unit 42 detects an oblong figure of the musical note having a width equivalent to a distance between two adjacent lines composing the staff (step 1002). The coordinate of the center of the detected oblong figure is stored in RAM 15 (step 1002). The musical-score element extracting unit 42 judges whether or not the process of step 1002 has been performed with respect to all the part lines (step 1003). When it is determined NO at step 1003, the musical-score element extracting unit 42 returns to step 1002 to detect an oblong figure of the musical note in another rectangle range specified to contain the following part line.

When it is determined YES at step 1003, the musical-score element extracting unit 42 detects a vertical line, which has a substantially the same length as the part line and is placed separately by a predetermined distance from the oblong figure corresponding to the detected musical note, in the range of the musical score containing the part line and the upper and lower portions to the part line (step 1004). The musical-score element extracting unit 42 stores the detected vertical line in RAM 15 (step 1005). The musical-score element extracting unit 42 judges whether or not the processes of steps 1004 and 1005 have been performed with respect to all the part lines (step 1006). When it is determined NO at step 1006, the musical-score element extracting unit 42 returns to step 1004, and performs the similar processes in the rectangle range specified to contain the following part line at steps 1004 and 1005. When it is determined YES at step 1006, the bar-line detecting process finishes.

Figure 11:
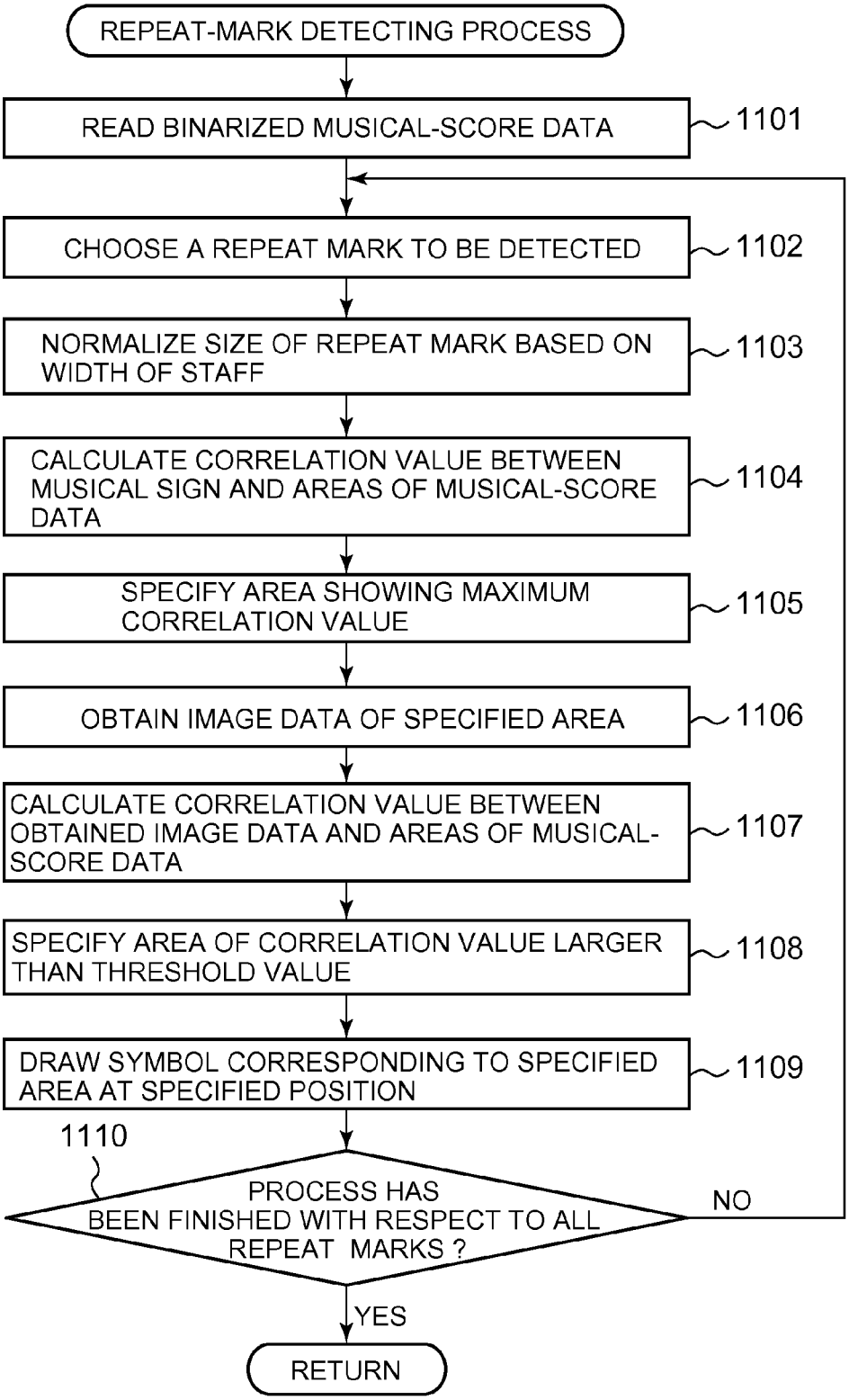
FIG. 11 is a flow chart of an example of a repeat-mark detecting process performed in the embodiment of the invention.
Figure 12A:
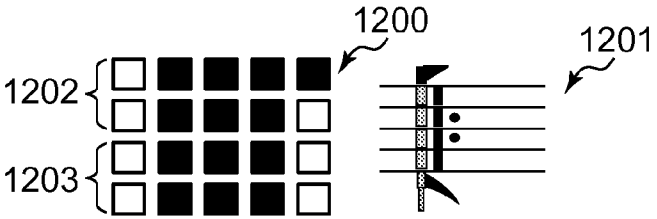
FIG. 12*a* to FIG. 12*e* are views showing samples of repeat marks and the corresponding symbols.
Figure 12B:
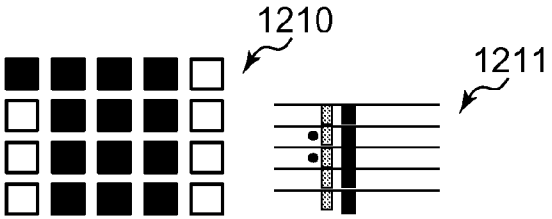
Figure 12C:
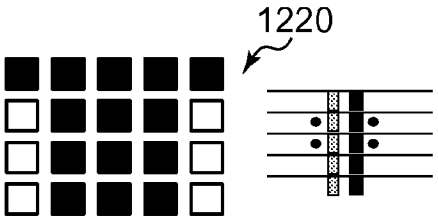
Figure 12D:
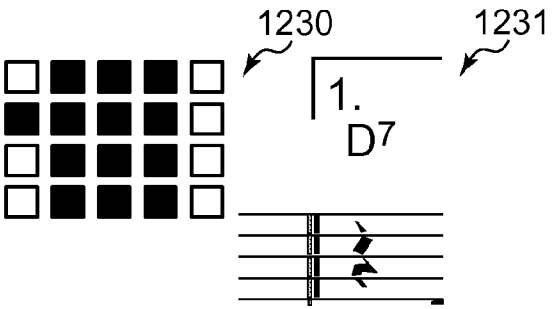
Figure 12E:
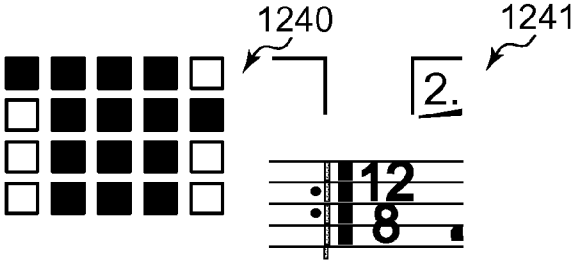

When the bar-line detecting process finishes (step 504 in FIG. 5), the musical-score element extracting unit 42 detects a repeat mark. FIG. 11 is a flow chart of an example of a repeat-mark detecting process performed in the present embodiment of the invention. The musical-score element extracting unit 42 reads binarized musical-score data from RAM 15 (step 1101). The musical-score element extracting unit 42 chooses a repeat mark to be detected (step 1102). As shown in FIG. 12 and FIG. 13, the following repeat marks are included, that is, Left repeat sign (Reference numeral: 1201), Right repeat sign (Reference numeral: 1211), First ending (Reference numeral: 1231), Second ending (Reference numeral: 1241), To Coda (Reference numeral: 1301), Coda mark (Reference numeral: 1311), Segno (Reference numeral: 1321), Dal Segno (Reference numeral: 1331), and Da Capo (not shown). Image data of figures of these repeat marks is previously stored in RAM 15, and the musical-score element extracting unit 42 reads the image data of a predetermined repeat mark from RAM 15.

Then, the musical-score element extracting unit 42 normalizes a size of the musical mark or symbol based on the width between the bottom line and the top line of the staff on the musical score (step 1103). Further, the musical-score element extracting unit 42 calculates a contingency coefficient (correlation value) between the musical mark and a predetermined area of the image data (step 1104). For example, pixels of image data of the musical mark are compared with pixels of image data of the predetermined area, and when the pixel values coincide with each other, the contingency coefficient is incremented, whereby the final contingency coefficient is obtained as a correlation value. The musical-score element extracting unit 42 successively shifts the area in the musical-score data to calculate the correlation values for all the areas in the musical-score data. The musical-score element extracting unit 42 specifies the area showing the maximum correlation value (step 1105), and extracts image data of the area (step 1106).

The musical-score element extracting unit 42 compares pixels of the extracted image data with pixels of image data of a predetermined area of the musical-score data to calculate a correlation value (step 1107). Since the repeat mark detected in the area specified at step 1105 is the mark used on the musical score, in order to detect the same sign more accurately, the mark is detected again at step 1107 with use of the image data of the detected area. The musical-score element extracting unit 42 specifies the areas showing the correlation value larger than a certain threshold value (step 1108). The musical-score element extracting unit 42 draws symbols corresponding to the repeat marks in the specified areas on the musical score (step 1109). The musical-score element extracting unit 42 judges whether or not the above processes have been performed with respect to all the repeat marks (step 1110). When it is determined YES at step 1110, the process finishes. When it is determined NO at step 1110, the musical-score element extracting unit 42 returns to step 1102.

Hereinafter, the symbols corresponding to the repeat marks will be described. In FIG. 12*a* to FIG. 12*e* and FIG. 13*a* to FIG. 13*d*, the repeat marks (Reference numerals: 1201, 1211, 1231, and 1241, and Reference numerals: 1301, 1311, 1321 and 1331) are illustrated to the right and the corresponding symbols (Reference numerals: 1200, 1210, 1220, 1230, and 1240 and Reference numerals: 1300, 1310, 1320 and 1330) are illustrated to the left. The symbol 1200 corresponding to the left repeat sign 1201 consists of the predetermined number of pixels. In these symbols, dots in the top two layers (Reference numerals: 1202) are used to represent the left repeat sign, the right repeat sign, the first ending, and the second ending, and dots in the bottom two layers (Reference numerals: 1203) are used to represent To Coda, Coda mark, Segno, Dal Segno, and Da Capo. A position where a black pixel is placed in the top of the top two layers makes a distinction between the left repeat sign and the right repeat mark. That is, the black pixel placed to the right of the top of the top two layers indicates the left repeat sign and on the contrary, the black pixel placed to the left of the top of the top two layers of the symbol indicates the right repeat sign (Refer to Reference numerals: 1200, 1210 and 1220). In a similar manner, the black pixel placed to the left of the bottom of the top two layers indicates the first ending (Refer to Reference numeral: 1230) and on the contrary, the black pixel placed to the right of the bottom of the top two layers indicates the second ending (Refer to Reference numeral: 1240).

Figure 13A:
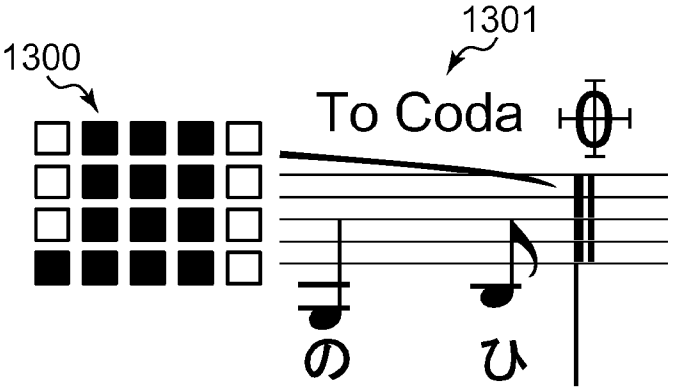
FIG. 13*a* to FIG. 13*d* are views showing samples of repeat marks and the corresponding symbols.
Figure 13B:
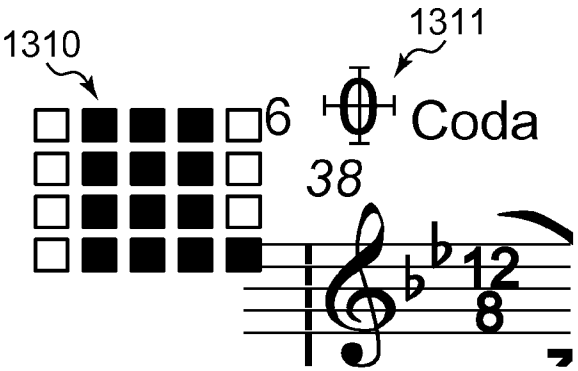
Figure 13C:
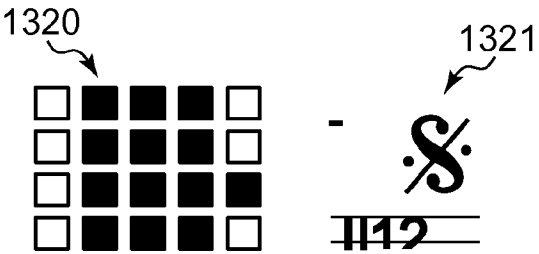
Figure 13D:
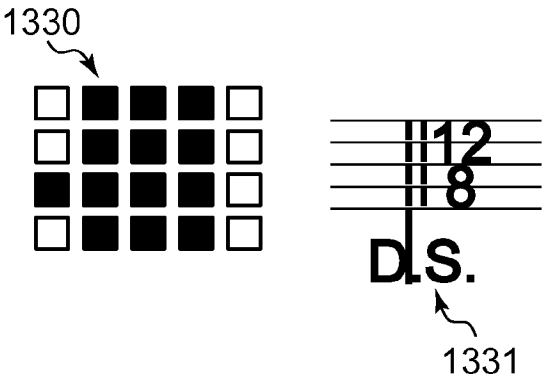

A position where the black pixel is placed in the bottom of the bottom two layers makes a distinction between To Coda and Coda, as shown in FIG. 13*a* and FIG. 13*b*. That is, To Coda is indicated by the black pixel placed to the left of the bottom of the bottom two layers (Refer to Reference numeral: 1300) and Coda is indicated by the black pixel placed to the right of the bottom of the bottom two layers (Refer to Reference numeral: 1310). A position where the black pixel is placed in the top layer of the bottom two layers makes a distinction between Segno and Dal Segno, as shown in FIG. 13*c* and FIG. 13*d*. That is, Segno is indicated by the black pixel placed to the right of the top of the bottom two layers (Refer to Reference numeral: 1320) and Dal Segno is indicated by the black pixel placed to the left of the top of the bottom two layers (Refer to Reference numeral: 1330).

The symbol consisting of the predetermined number of pixels is drawn in the detected area or its vicinity of the binarized musical-score data at step 1109. The symbol is referred to, when a pixel-element data file to be described is generated. In the present embodiment of the invention, the repeat mark is detected, and the symbol corresponding to the detected repeat mark is disposed in the vicinity to the position where the repeat mark has been detected in the binarized musical-score data. But the technique is not limited to the above, and when the repeat mark is detected, an arrangement may be made such that information representing the repeat mark and the position where said sign is detected is stored in RAM 15.

Figure 14:
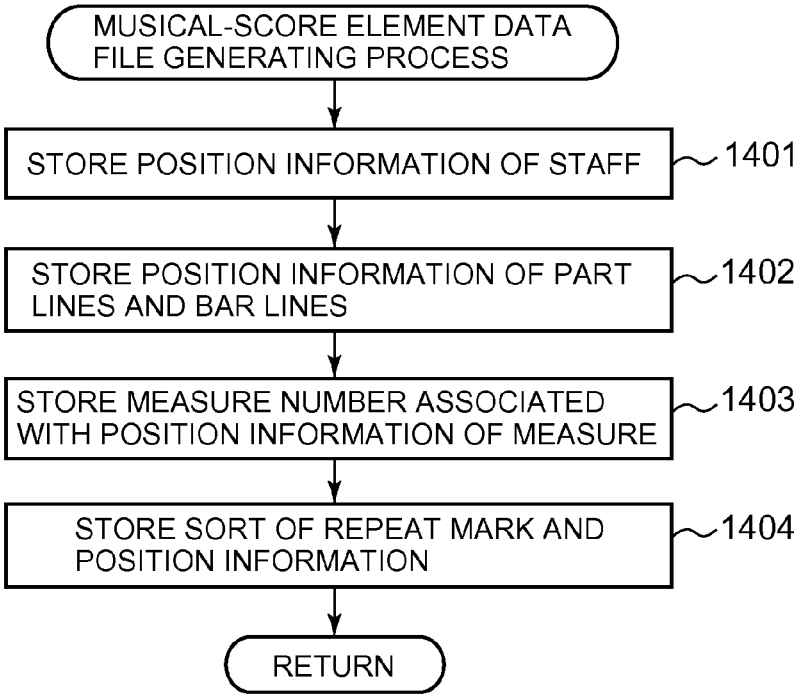
FIG. 14 is a flow chart of an example of a musical-score element data file generating process in the embodiment of the invention.

When the repeat-mark detecting process has finished at step 505 in FIG. 5, the data-file generating unit 43 generates a musical-score element data file, using the information obtained in the processes at step 502 to 505 (step 506). FIG. 14 is a flow chart of an example of the musical-score element data file generating process in the present embodiment of the invention. The data-file generating unit 43 stores the position information of staff and the position information of part lines and bar lines stored in RAM 15 in the musical-score element data file in RAM 15 in a predetermined order and also in a predetermined format (steps 1401, 1402). Then, the data-file generating unit 43 associates the number of the measure (measure number) with the position of the measure having said measure number, based on the position of the part line, positions of the bar lines, and the position of the staff, and stores the measure numbers of the measures and the associated positions in the musical-score element data file in RAM 15 (step 1403). Further, the data-file generating unit 43 judges whether or not any symbol of the repeat mark has been found in the vicinity of the part line and/or bar lines. When it is determined that a symbol of the repeat mark has been found, the data-file generating unit 43 stores the sort of the repeat mark corresponding to the found symbol and its position information in the musical-score element data file in RAM 15 (step 1404), wherein the position information represents, for example, the number of the measure, in which the repeat mark is placed, and the part line and/or the bar lines adjacent to the repeat mark. In this manner, a musical-score element data file is generated, which stores musical-score element information containing the staff, the part lines, the bar lines, the repeat marks, and the positions of the measures included in the musical score. Further, in the case where the musical score contains plural parts, it is preferable that the musical-score element file contains information, which represents positions of staffs and the corresponding parts (tone color).

Figure 15:
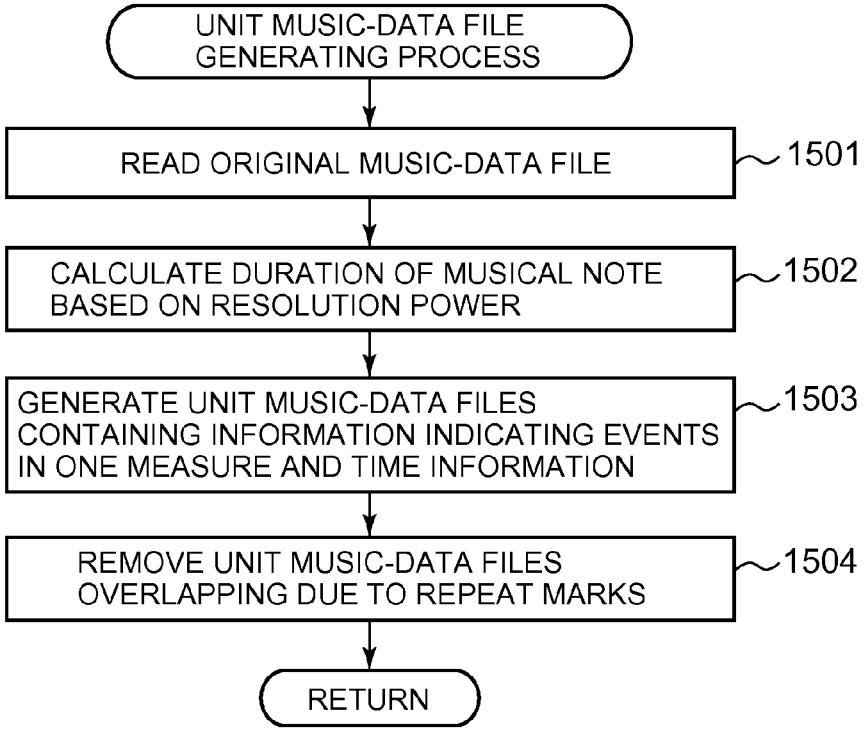
FIG. 15 is a flow chart of an example of a unit music-data file generating process performed by a music-data dividing unit.

The music-data dividing unit 44 divides the original music-data file into plural data files per measure (unit music-data file per measure) and refers to the musical-score element data file to specify overlapping measures due to the repeat mark(s), thereby deleting one of the overlapping unit music-data files. FIG. 15 is a flow chart of an example of a unit music-data file generating process to be performed by the music-data dividing unit 44. The music-data dividing unit 44 reads the original music-data file from the flash memory 16 (step 1501). The original music-data file contains time information (delta time) indicating time intervals each between events including generation of musical tones (note-on events), information indicating events including note-on events, information indicating a unit of time (or a resolution power of a unit time to break down a quarter note, for example, resolution power of 240), and information indicating a rhythm of music. The time information between a note-on event and a note-off event tells the duration of a musical note of the note-on event.

Referring to the information indicating events and the time information in the original music data, the music-data dividing unit 44 calculates a duration of each musical note in the musical piece from the beginning based on the resolution power (step 1502), and generates a unit music-data file, in which one file contains information indicating events in one measure and time information (step 1503). The generated unit music-data file is stored in RAM 15. The music-data dividing unit 44 deletes overlapping unit music-data files based on information relating to the repeat mark(s) (sorts and positions of the repeat marks) contained in the musical-score element data file (step 1504).

Figure 16A:
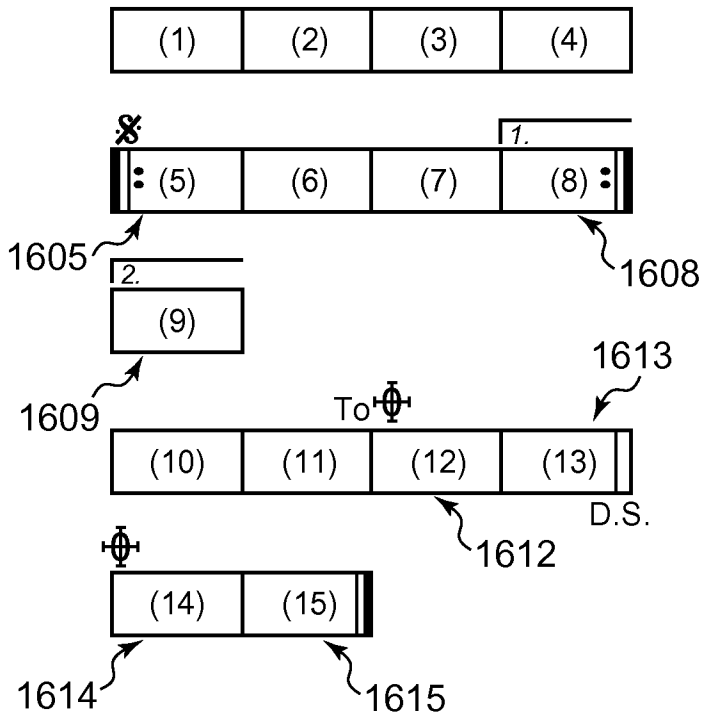
FIG. 16*a* is a view schematically showing a configuration of a musical score of some musical piece.
Figure 16B:
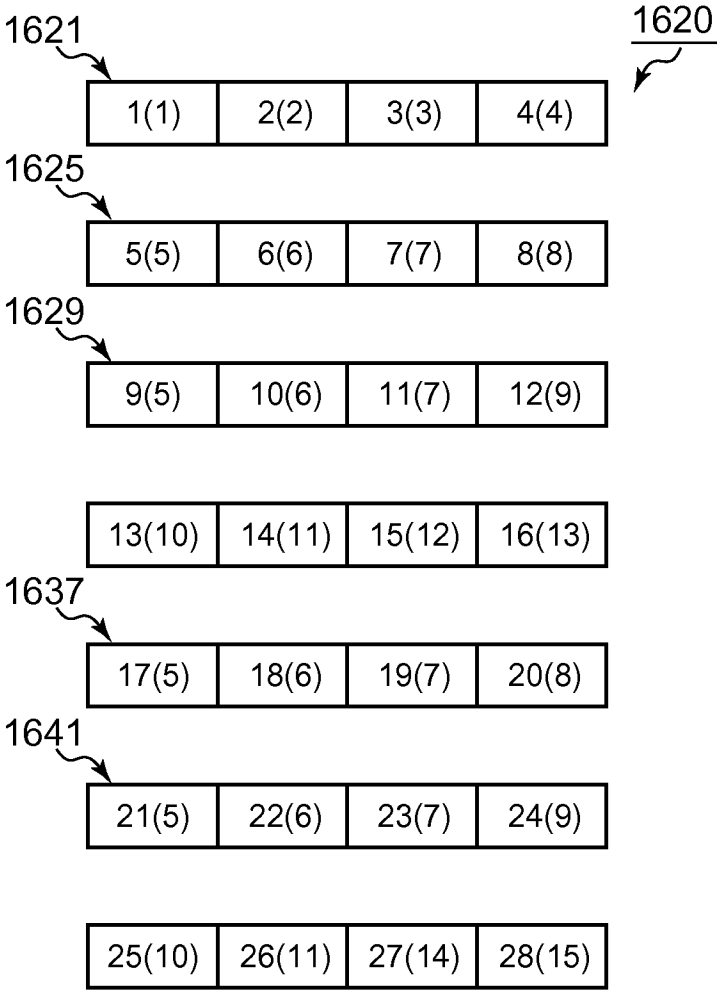
FIG. 16*b* is a view schematically showing a configuration of original music data of the musical piece.

FIG. 16*a* is a view schematically showing a configuration of a musical score of some musical piece. FIG. 16*b* is a view schematically showing a configuration of the original music data of the musical piece. In FIG. 16*a* and FIG. 16*b*, numerals in parenthesis denote the numbers of the measures (measure numbers). In FIG. 16*b*, numerals to the left of the measure numbers denote the file numbers of the unit music-data files. When a file is generated in the process at step 1503 in FIG. 15, the music-data dividing unit 44 gives the file the file number. For example, the leading unit music-data file (reference numeral: 1621) in FIG. 16*b* is given the file number of "1" and corresponds to the first measure, as shown by the numeral in parenthesis.

As shown in FIG. 16*a*, the musical piece has the left repeat sign and Segno at the beginning of the fifth measure (Reference numeral: 1605), and the first ending at the beginning of the eighth measure (Reference numeral: 1608) and the right repeat sign at the ending of the eighth measure. The musical piece has the second ending at the beginning of the ninth measure (Reference numeral: 1609). Further, the musical piece has To Coda at the beginning of the 12-th measure (Reference numeral: 1612), Dal Segno at the ending of the 13-th measure (Reference numeral: 1613), and Coda at the beginning of the 14-th measure (Reference numeral: 1614). As shown in FIG. 16*b*, the original music-data file is divided into 28 pieces of unit music-data files per measure. Since repeat marks are contained, plural unit music-data files (Reference numerals: 1625, 1629, 1637 and 1641) corresponding to the fifth measure are contained.

Figure 31:
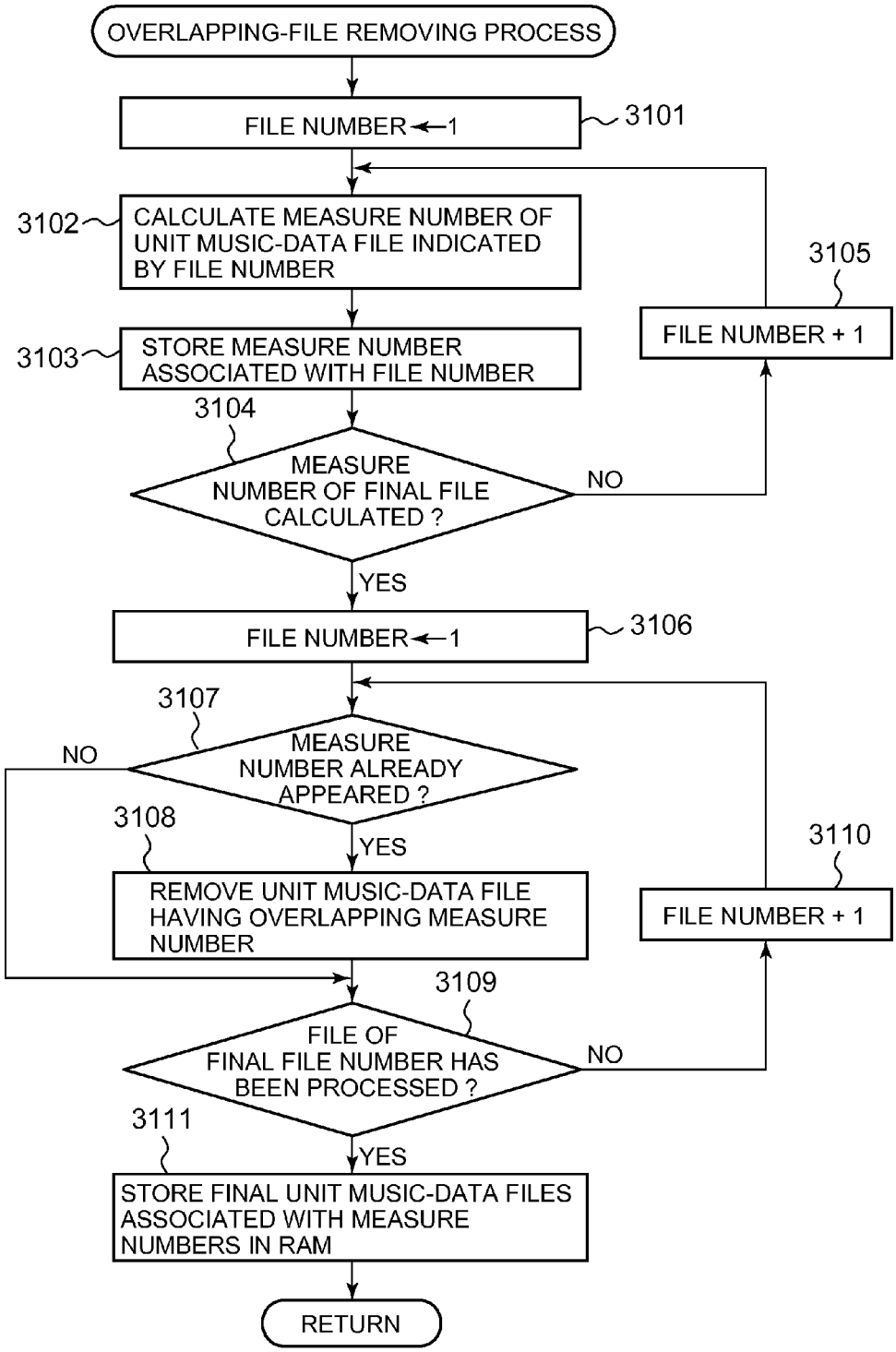
FIG. 31 is a flow chart of an example of a detailed process performed at step 1504 in FIG. 15.

FIG. 31 is a flow chart showing an example of a process performed at step 1504 in FIG. 15 in more detail. The music-data dividing unit 44 initializes a parameter indicating the file number to "1" (step 3101). Referring the repeat mark, the music-data dividing unit 44 calculates the measure number on the musical score with respect to the unit music-data file indicated by the file number (step 3102). The measure number is associated with the file number of the unit music-data file and stored in RAM 15 (step 3103). The music-data dividing unit 44 judges whether or not the measure number has been calculated with respect to the file having the final file number (step 3104). When it is determined NO at step 3104, the music-data dividing unit 44 increments the file number (step 3105), and returns to step 3102.

When it is determined YES at step 3104, the music-data dividing unit 44 initializes the file number to "1", again (step 3106), and judges whether or not the measure number associated with the music-data file indicated by the file number has already appeared (step 3107). When it is determined YES at step 3107, the music-data dividing unit 44 removes the unit music-data file having the overlapping measure number (step 3108). The music-data dividing unit 44 judges whether or not the unit music-data file having the final file number has been subjected to the process (step 3109). When it is determined NO at step 3109, the music-data dividing unit 44 increments the file number (step 3110), and returns to step 3107. The unit music-data files, which have not been removed in the above processes, will be the final files with no overlapping files. The music-data dividing unit 44 associates the unit music-data files, which have not been removed and left, with the measure numbers, respectively and stores these files as the final music-data files in RAM 15 (step 3111).

Figure 17:
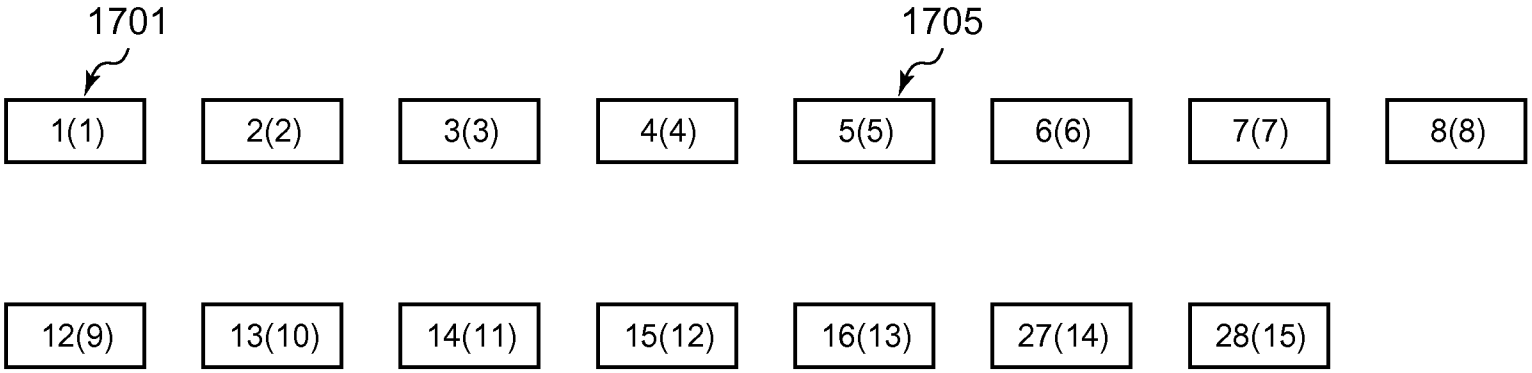
FIG. 17 is a view showing an example of plural unit music-data files with overlapping files removed.

In the example shown in FIG. 17, with reference to the musical-score element data file, since the fifth measure to the seventh measure are to be repeated, the music-data dividing unit 44 determines that the unit music-data files having the file numbers 9 to 11 represent the fifth measure to the seventh measure to be repeated, and determines to remove these unit music-data files having the file numbers 9 to 11. In a similar manner, it is detected in the musical-score element data file that Dal Segno instructs to repeat back from the 13-th measure to the fifth measure, and in consideration of the above repeat mark, To Coda at the 12-th measure and Coda at the 14-th measure, it is determined that the unit music-data files of the file numbers 17 to 26 are removed.

In this way, the music-data dividing unit 44 obtains 15 final unit music-data files with no overlapping files included, as shown in FIG. 17. The music-data dividing unit 44 assigns the unit music-data files with the file numbers in the order of files, respectively. In FIG. 17, the reference numerals 1701 and 1705 denote the unit music-data files. Since overlapping files have been removed, unit music-data files consist only of the files corresponding to the measure numbers in the musical score, as shown in FIG. 16*a* and the order of the unit music-data files coincides with the order of the measure numbers on the musical score.

As will be described in detail, when the unit music-data files are reproduced to generate musical tones, the repeat marks in the musical-score element data file are referred to and the unit music-data files to be reproduced are specified in accordance with the repeat marks.

Figure 18:
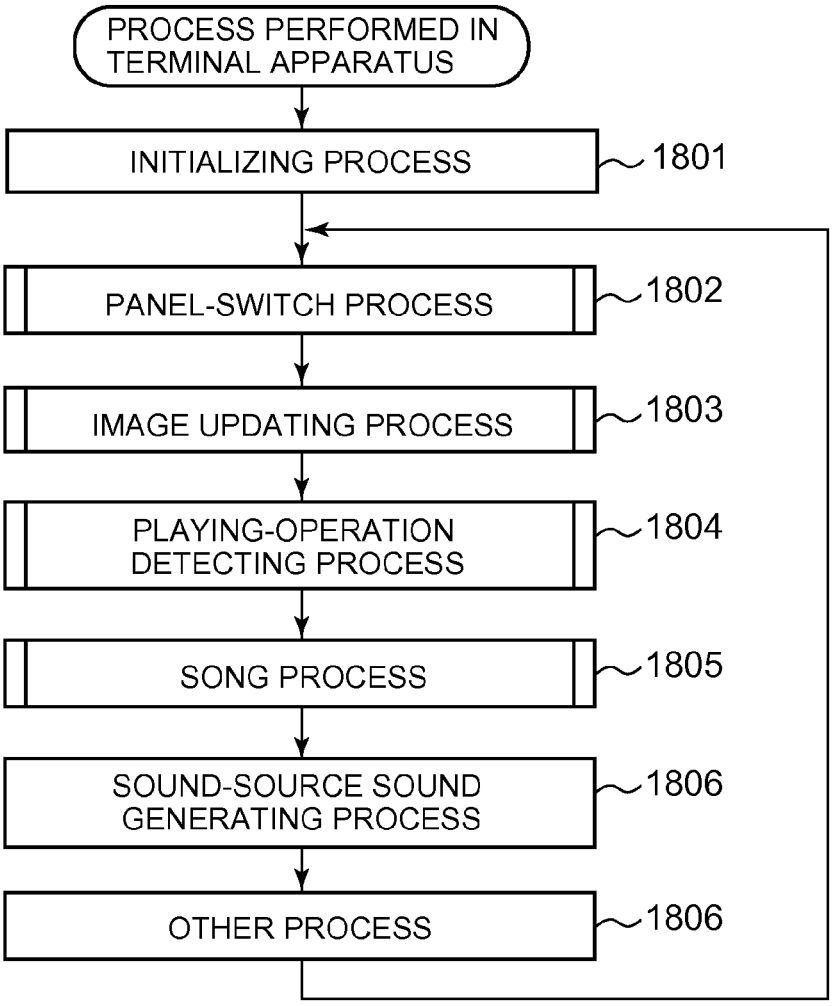
FIG. 18 is a flow chart of an example of a process to be performed by the terminal apparatus according to the embodiment of the invention.

Hereinafter, a process to be performed in the terminal apparatus 30 according to the present invention will be described in detail. FIG. 18 is a flow chart of an example of a process to be performed by the terminal apparatus 30 according to the present invention. CPU 31 of the terminal apparatus 30 executes an initializing process, clearing data in RAM 35 and also clearing a display screen of the displaying unit 33 (step 1801), when the power of the terminal apparatus 30 is turned on.

Figure 19:
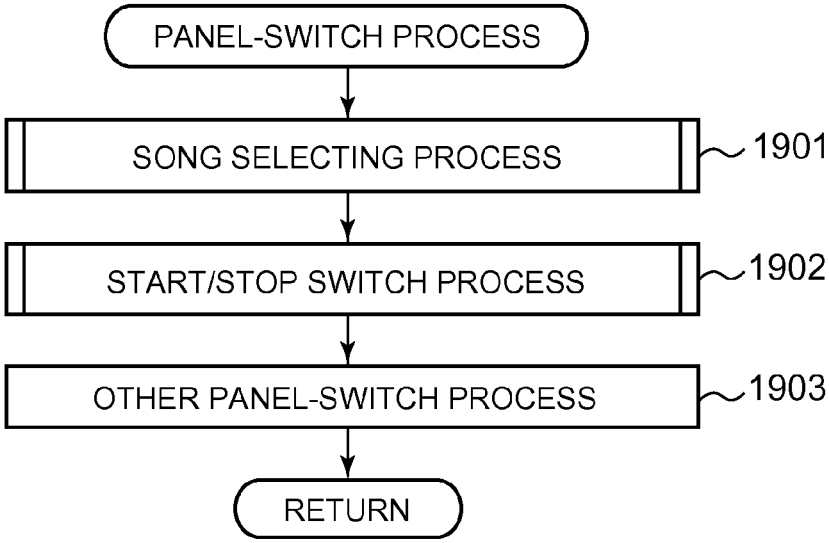
FIG. 19 is a flow chart of an example of a panel-switch process performed in the embodiment of the invention.

After the initializing process at step 1801, CPU 31 detects a switching operation on the touch panel 32 to perform a process in accordance with the detected switching operation, thereby performing a panel-switch process (step 1802). For example, various icons are displayed on the display screen of the displaying unit 33 (Refer to Reference numeral: 301 in FIG. 3), and when the user touches one of the icons, CPU 31 detects the user's switching operation on the touch panel 32. FIG. 19 is a flow chart of an example of the panel-switch process performed in the present embodiment of the invention.

Figure 20:
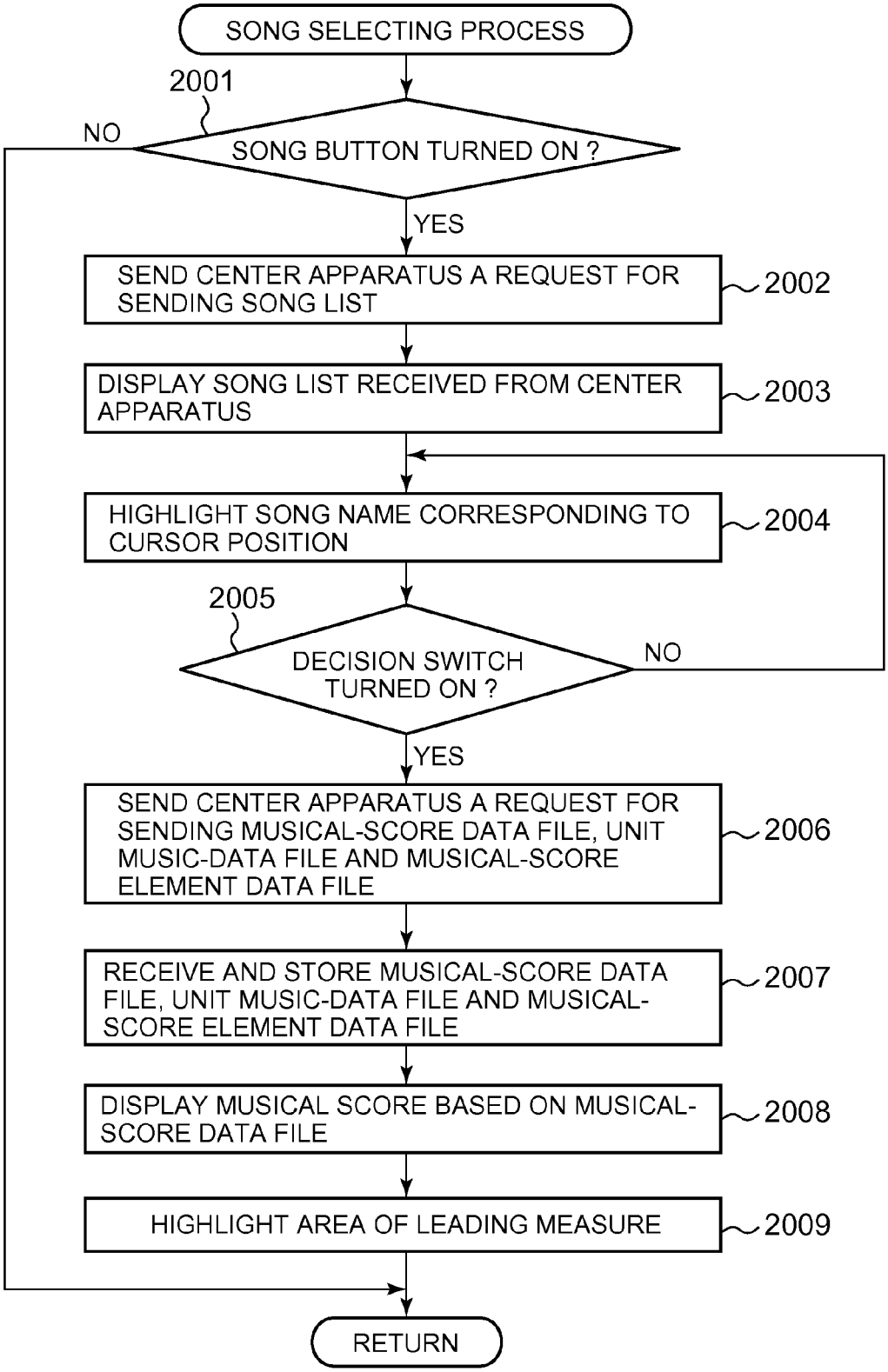
FIG. 20 is a flow chart of an example of a song selecting process performed in the embodiment of the invention.

As shown in FIG. 19, the panel-switch process includes a song selecting process (step 1901), a start/stop switch process (step 1902) and other panel switch process (step 1903). FIG. 20 is a flow chart of an example of the song selecting process performed in the present embodiment of the invention. CPU 31 judges whether or not a position corresponding to a song button on the touch panel 32 has been touched by the user (step 2001). When it is determined NO at step 2001, the song selecting process finishes.

When it is determined YES at step 2001, CPU 31 instructs the communication I/F 37 to send the center apparatus 10 a request for sending a song list (step 2002). In response to the instruction, the communication I/F 37 sends the center apparatus 10 the request for sending the song list, and receives the song list from the center apparatus 10. CPU 31 displays on the display screen of the displaying unit 33 the song list received by the communication I/F 37 (step 2003). The user is allowed to select his or her desired song by touching a cursor button displayed on the displaying unit 33. CPU 31 highlights a song name corresponding to a position where the cursor is placed in a list of songs displayed on the display screen of the display unit 33 (step 2004).

When it is determined that a decision switch displayed on the displaying unit 33 has been touched (YES at step 2005), CPU 31 gives the communication I/F 37 an instruction of sending the center apparatus 10 a request for sending the displaying musical-score data file, a series of unit music-data files, and the musical-score element data file of the musical piece of the selected song name (step 2006). In response to the instruction, the communication I/F 37 sends the center apparatus 10 the request for sending the displaying musical-score data file, a series of unit music-data files, and the musical-score element data file of the musical piece, and receives from the center apparatus 10 the displaying musical-score data file, a series of unit music-data files, and the musical-score element data file of the musical piece (step 2007). CPU 31 stores in the flash memory 36 the received displaying musical-score data file, a series of unit music-data files, and the musical-score element data file (step 2007).

Then, CPU 31 displays a musical score on the received display screen of the displaying unit 33 based on the musical-score data file (step 2008). CPU 31 highlights an area of the leading measure on the musical score based on coordinates of the vertical lines and bar lines in the musical-score element data file (step 2009). For example, only the area is displayed in different color and in a semi-transparent way.

Figure 21:
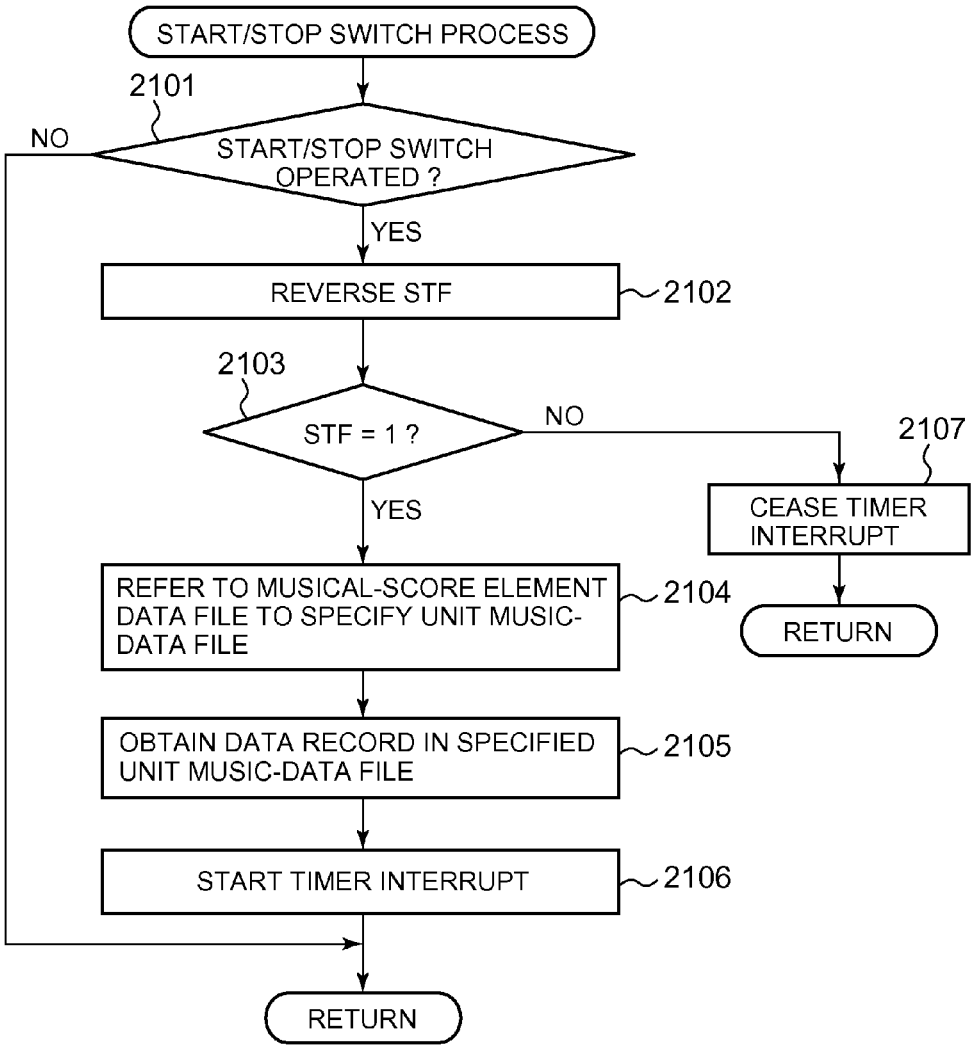
FIG. 21 is a flow chart of an example of a start/stop switch process performed in the embodiment of the invention.

Now, the start/stop switch process will be described. FIG. 21 is a flow chart of an example of the start/stop switch process performed in the present embodiment of the invention. CPU 31 judges whether or not the start/stop switch displayed on the displaying unit has been operated (step 2101). When it is determined NO at step 2101, the start/stop switch process finishes.

When it is determined YES at step 2101, CPU 31 reverses a start flag STF in RAM 35 (step 2102), and judges whether or not the start flag STF has been set to "1" (step 2103). When it is determined YES at step 2103, CPU 31 refers to the musical-score element data file to specify a unit music-data file (step 2104). For example, in the case that the initial start/stop switch is kept on, CPU 31 specifies the leading unit music-data file as a specific unit music-data file, or in the case that a reproducing operation of a music piece is stopped by operation of the start/stop switch, CPU 31 specifies the unit music-data file corresponding to the position where the reproducing operation has been stopped as the specific unit music-data file.

Then, CPU 31 obtains the data record of a predetermined address in the specified unit music-data file (step 2105). The obtained data record is stored in RAM 35. For example, when the start/stop switch is turned on for the first time, CPU 31 obtains the data record of the leading address, or in the case that the reproducing operation of a music piece is stopped by operation of the start/stop switch, CPU 31 specifies the unit music-data file corresponding to the position where the reproducing operation has been stopped as the specific unit music-data file.

Then, CPU 31 starts a timer interrupt (step 2106). When the timer interrupt is released, a timer interrupt process is performed at predetermined time intervals, incrementing the timer within CPU 31. When it is determined NO at step 2103, that is, when the start flag STF has been set to "0", CPU 31 ceases the timer interrupt (step 2107).

Thereafter, CPU 31 performs other panel switch process (step 1903 in FIG. 19). This other panel switch process includes a process of setting tempo data in accordance with a tempo-switch operation and storing the tempo data in RAM 35.

When the panel switch process finishes (step 1802 in FIG. 8), CPU 31 performs an image updating process (step 1803). In the image updating process, while the musical piece is being reproduced, CPU 31 highlights the area of the measure now being played on the displayed musical score, or alters a part of the musical score to be displayed on the display screen of the displaying unit 33. The image updating process will be described later, again.

Figure 22:
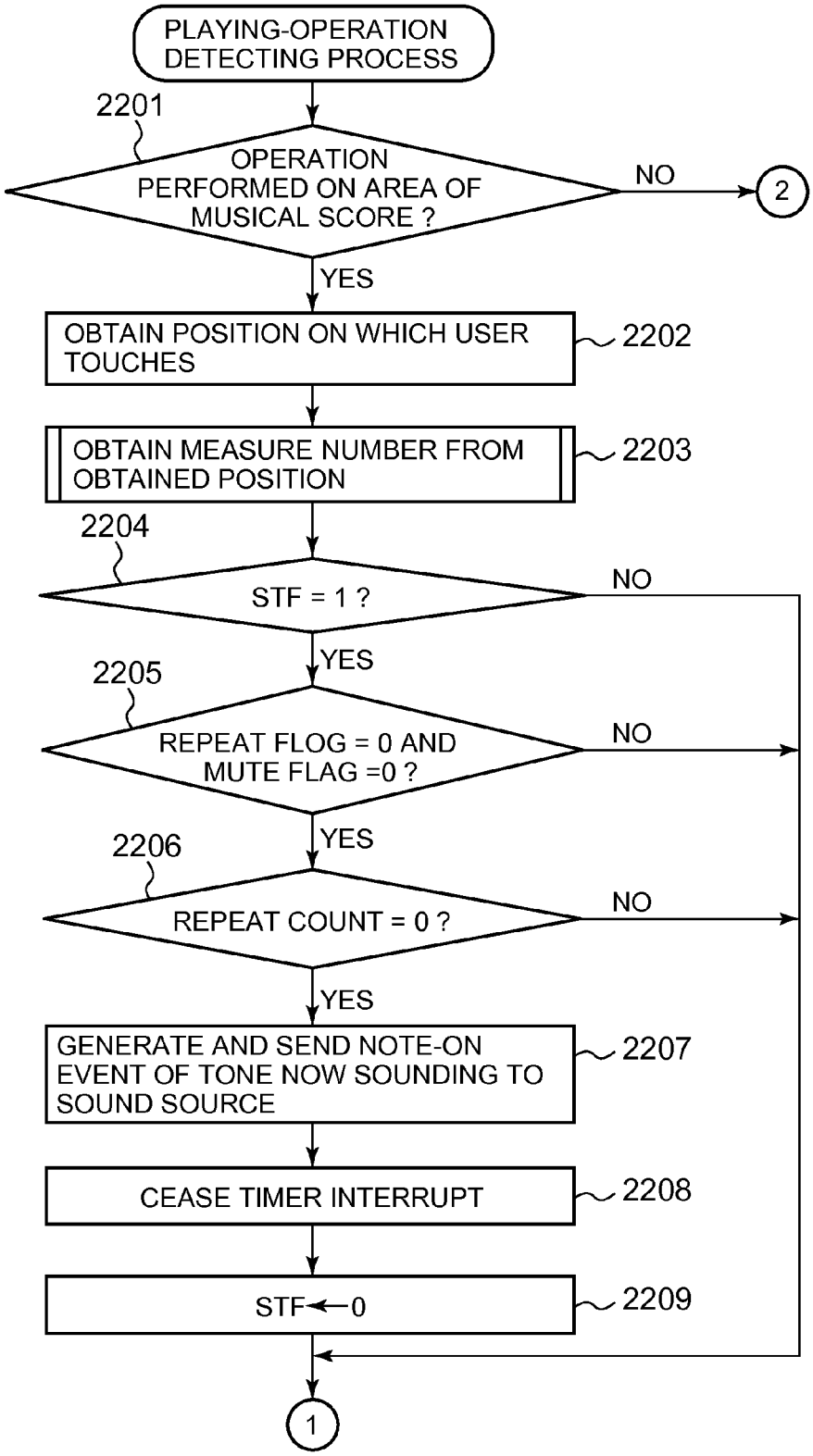
FIG. 22 is a flow chart of an example of a playing-operation detecting process performed in the embodiment of the invention.
Figure 23:
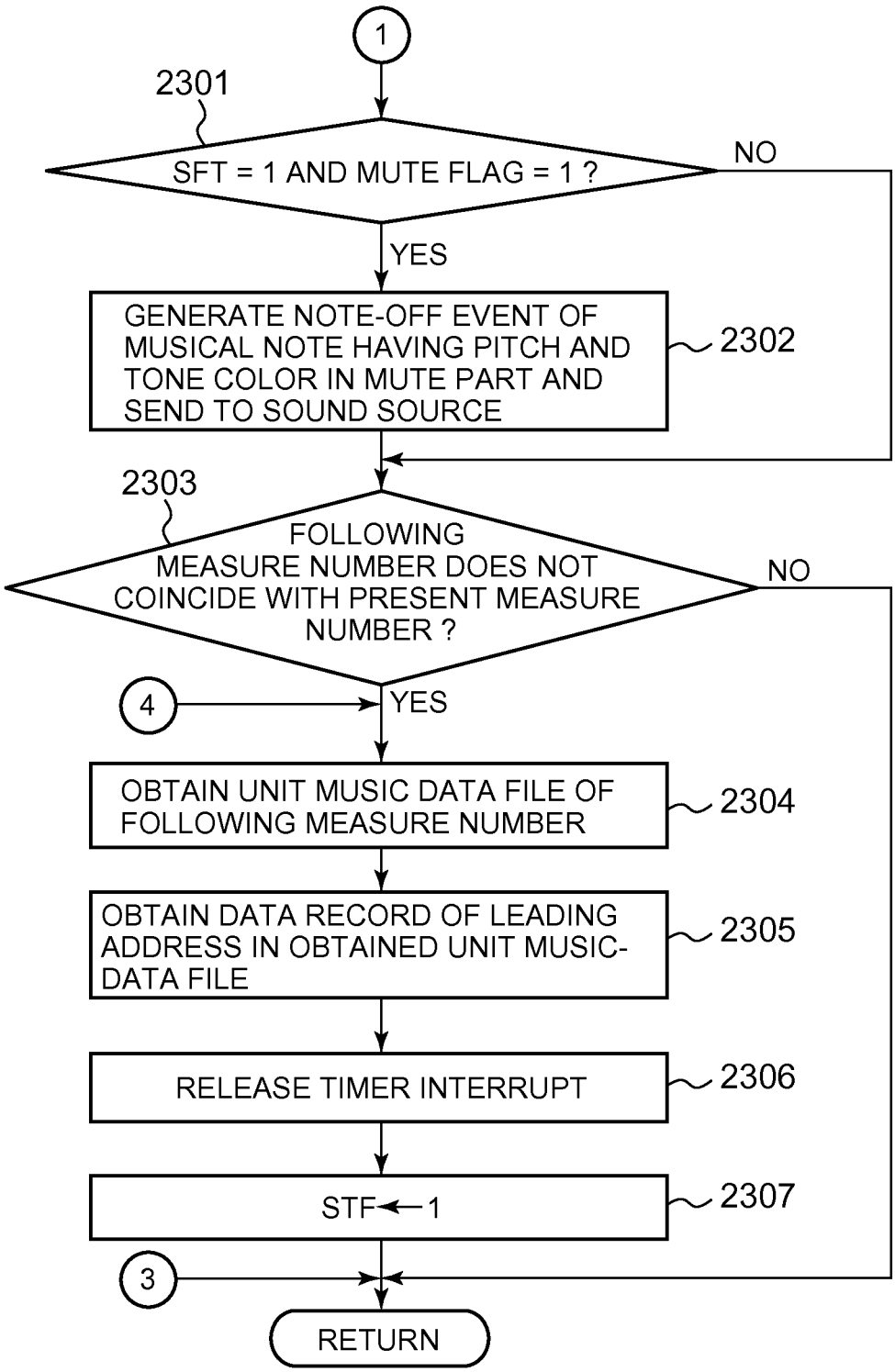
FIG. 23 is a flow chart of an example of the playing-operation detecting process performed in the embodiment of the invention.
Figure 24:
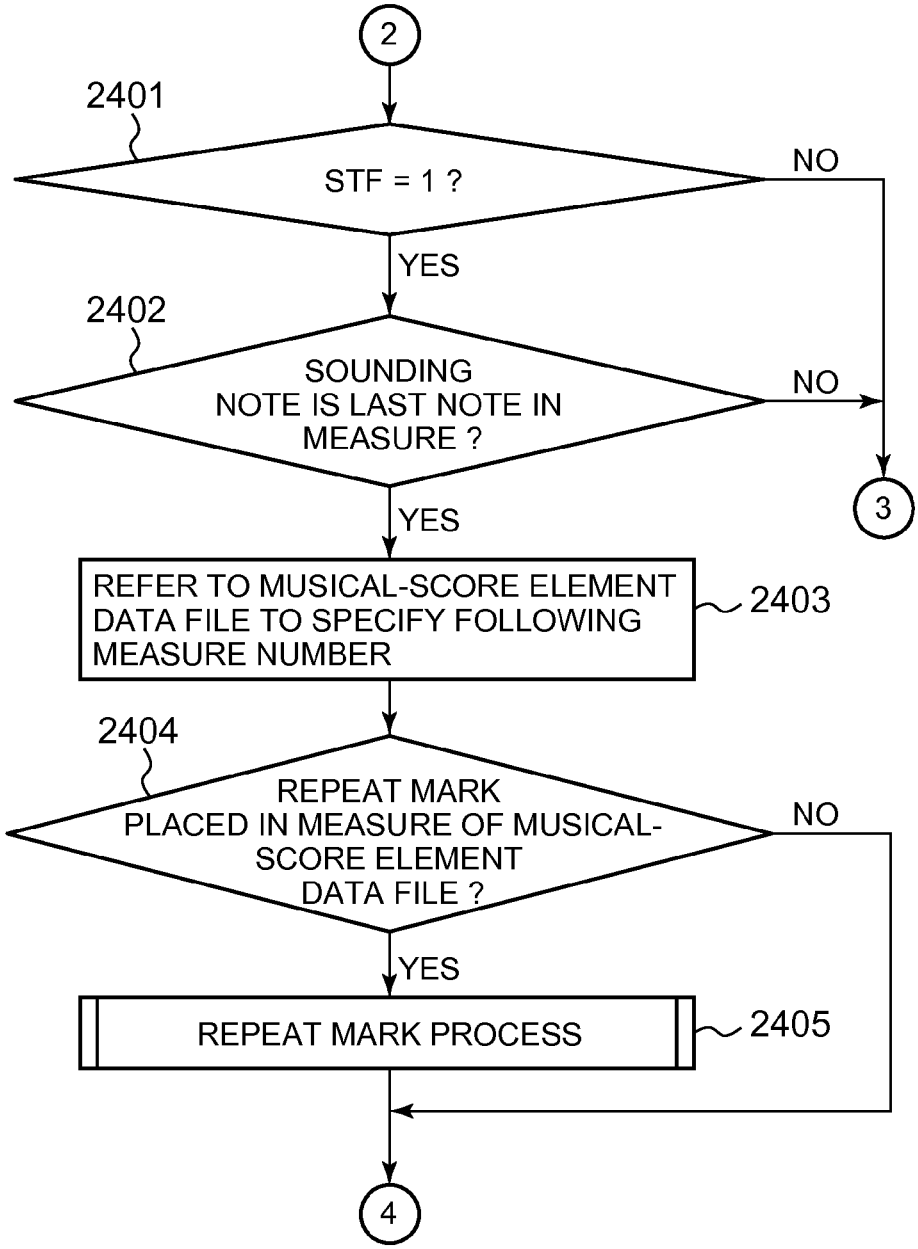
FIG. 24 is a flow chart of an example of the playing-operation detecting process performed in the embodiment of the invention.
Figure 25:
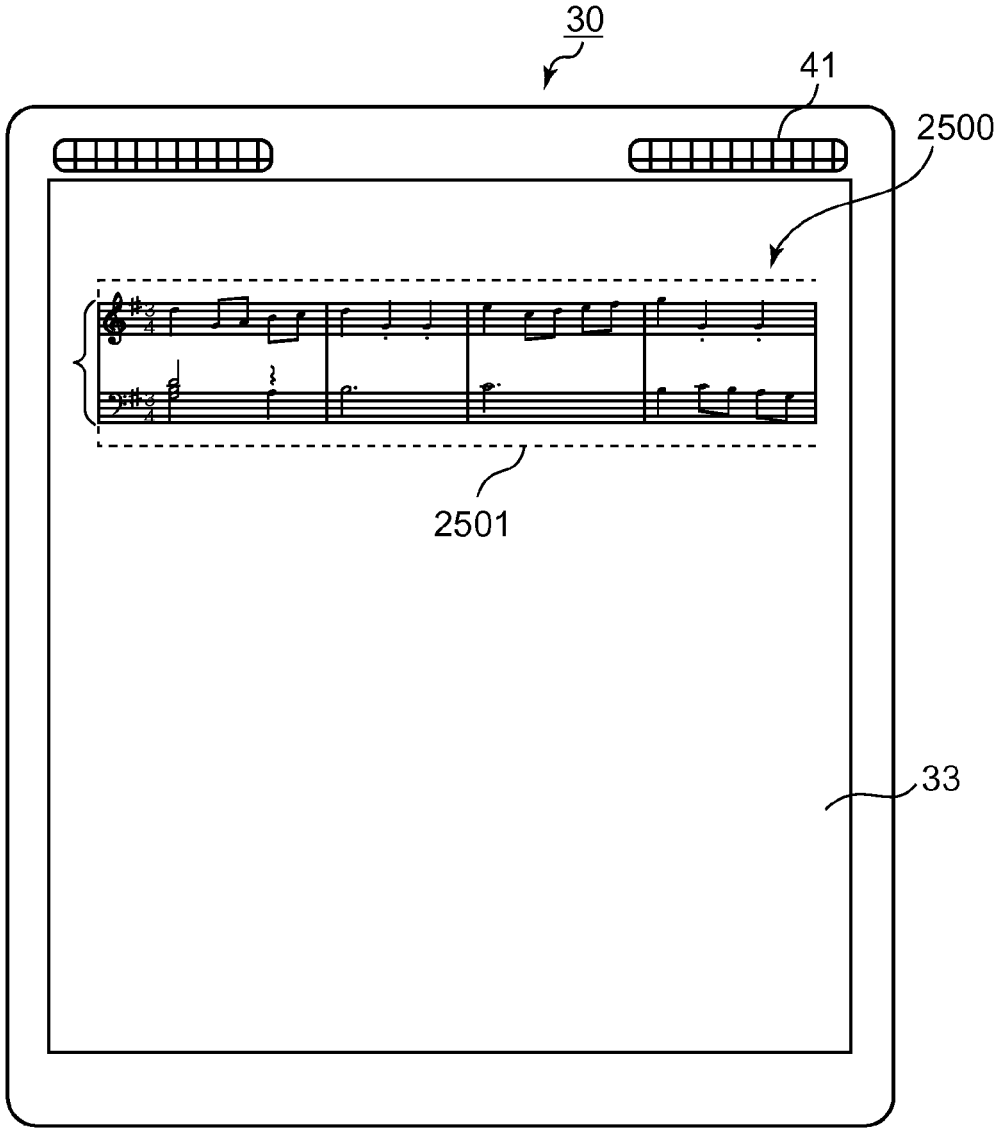
FIG. 25 is a view showing an example of the display screen of the displaying unit in the terminal apparatus, on which a musical score is displayed.

When the image updating process finishes (step 1803), CPU 31 performs a playing-operation detecting process (step 1804). FIG. 22 to FIG. 24 are flow charts of an example of the playing-operation detecting process in the present embodiment of the invention. CPU 31 judges whether or not an operation (user's touching operation) has been performed on an area of the musical score displayed on the displaying unit 33 (step 2201). FIG. 25 is a view showing an example of the display screen of the displaying unit 13 in the terminal apparatus 30, on which a musical score is displayed. In FIG. 25, for example, an area surrounded by a broken line 2501 is the area where the musical score is shown.

When it is determined YES at step 2201, CPU 31 obtains a coordinate of the position on the musical score where the user touches (step 2202). In addition to the coordinate of the position, CPU 31 obtains and stores in RAM 35 the number of times the user performs operation, a time when the user performs the operation, a time duration, in which the user performs the operation, and a time lapse (difference value) from the last operation at step 2202. Then, CPU 31 obtains the measure number corresponding to the position touched or operated by the user from the coordinate of the position touched or operated by the user and the musical-score element data file (step 2203).

Figure 26:
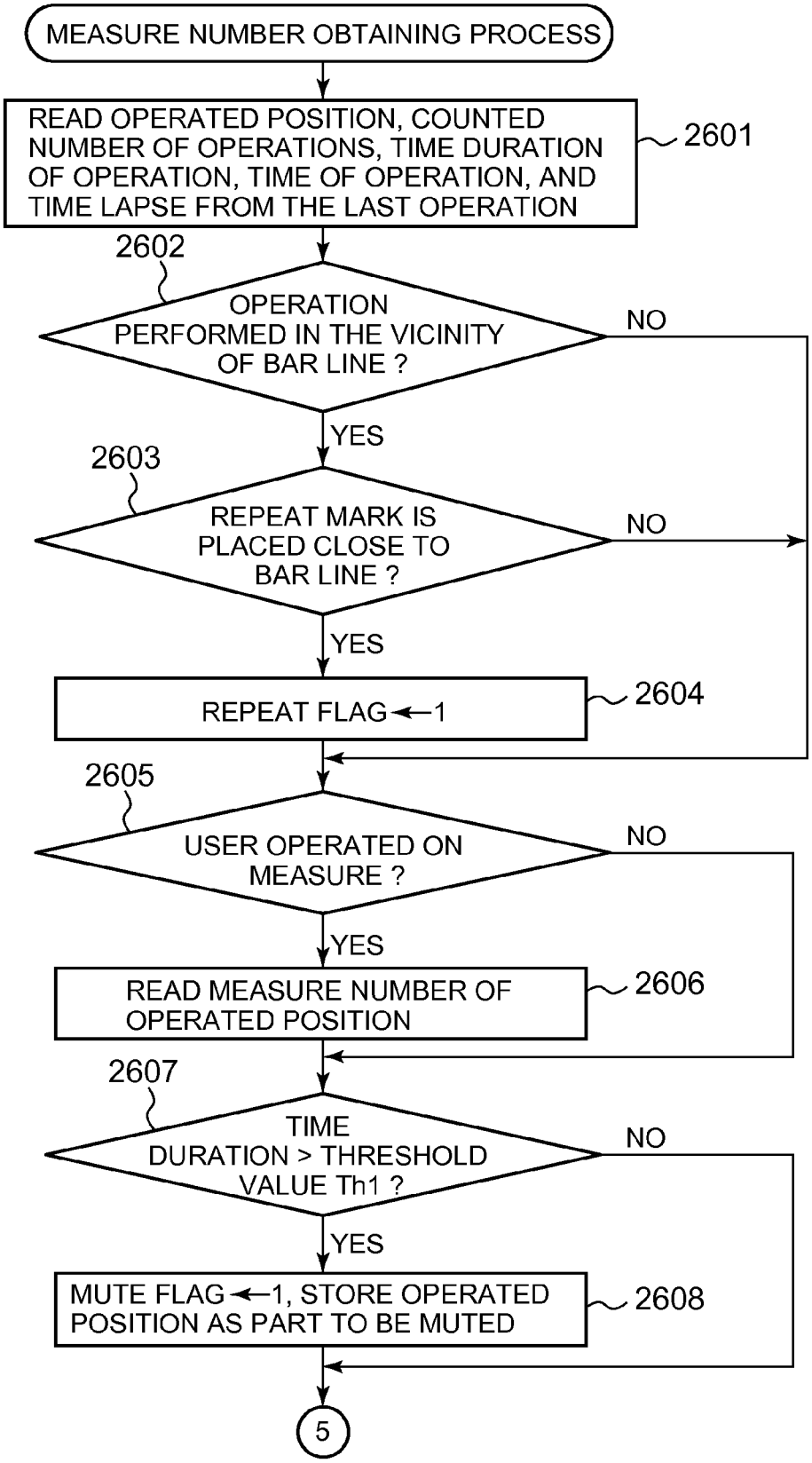
FIG. 26 is a flow chart showing a process at step 2203 in FIG. 22 in more detail.
Figure 27:
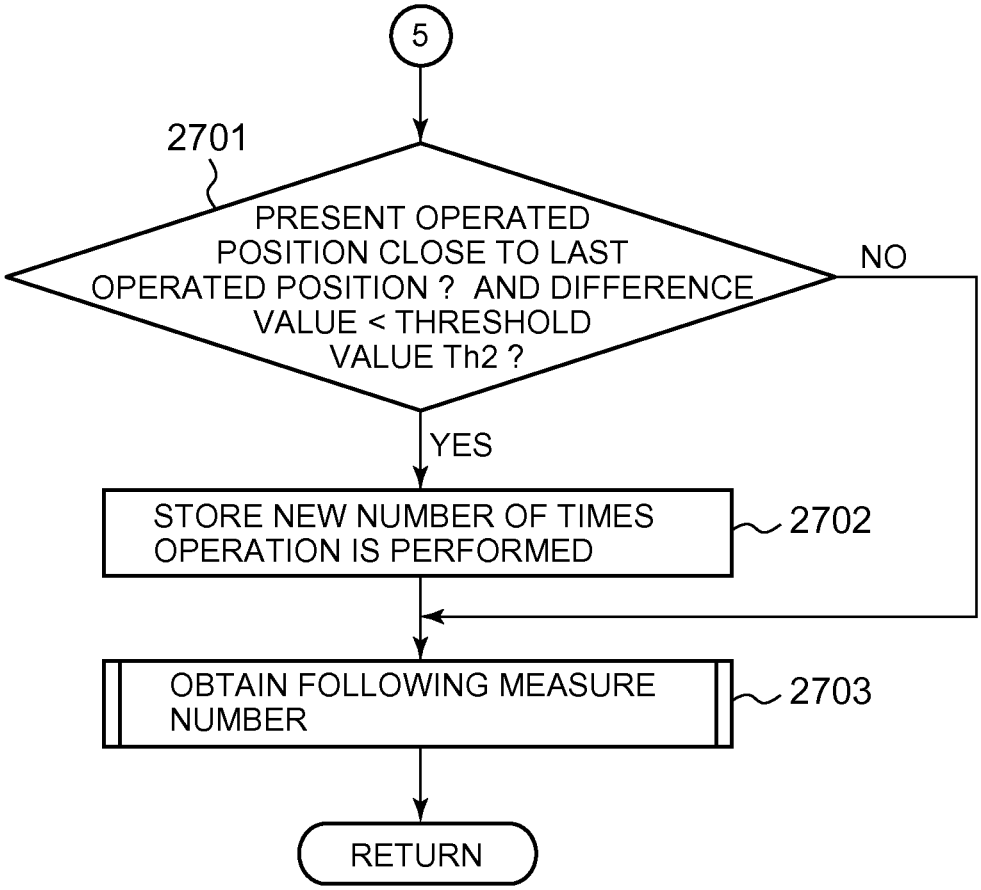
FIG. 27 is a flow chart showing the process at step 2203 in FIG. 22 in more detail.

FIG. 26 and FIG. 27 are flow charts showing a process to be performed at step 2203 in FIG. 22 in more detail. CPU 31 reads from RAM 15 the coordinate of the position where the user has performed operation, the number of times the user performs the operation, the time when the user performs the operation, the time duration, in which the user performs the operation, and the difference value (a time lapse between the when the user has performed the current operation and the time when the user performed the last operation) (step 2601). Then, CPU 31 judges whether or not the user has operated in the vicinity of the bar line (step 2602). More specifically, it is judged at step 2602 whether or not the user has operated within a predetermined rectangle area containing the bar line therein.

When it is determined YES at step 2602, CPU 31 refers to the musical-score element data file and judges whether or not any repeat mark is placed in the vicinity of the bar line close to the position where the operation has been performed by the user (step 2603). When it is determined YES at step 2603, CPU 31 sets a repeat flag in RAM 35 to "1" and stores information of the repeat mark in RAM 35 (step 2604).

CPU 31 judges whether or not the user has operated on the measure of the musical score, that is, the position where the user has operated falls within a range defined by the staff and bar lines (step 2605). When it is determined YES at step 2605, CPU 31 refers to the musical-score element data file and obtains the measure number corresponding to the position where the user has operated (step 2606). Further, CPU 31 judges whether or not the time duration of the user's operation is longer than a threshold value Th1 (step 2607). When it is determined at step 2607 that the time duration is longer than the threshold value Th1 (YES at step 2607), CPU 31 sets a mute flag to "1" (step 2608). In addition to setting the mute flag to "1" at step 2608, with reference to the positions of the part lines and the position of the staff in the musical-score element data file, CPU 31 sets the part corresponding to the position where the user has operated as a part to be muted (mute-part), storing information indicating the part in RAM 35, in the case where the displayed musical score consists of plural parts. It is possible to use position information of the staff to be muted as the information indicating the part.

Then, CPU 31 judges whether or not the position where the user has operated falls within a predetermined range of the position where the user operated the last time and the difference value between the time when the user has operated and the time when the user operated the last time is less than a threshold value Th2 (step 2701). When it is determined at step 2701 that the position where the user has operated is within the predetermined range of the position where the user operated the last time and the difference value between the time when the user has operated and the time when the user operated the last time is less than a threshold value Th2 (YES at step 2701), CPU 31 adds the number of times the user performs the operation this time to the number of times the user has performed the operation, and stores the new number of operations in RAM 35 (step 2702). Thereafter, CPU 31 obtains the measure number of a measure to be played in response to the user's operation performed on the musical score (step 2703).

Figure 28:
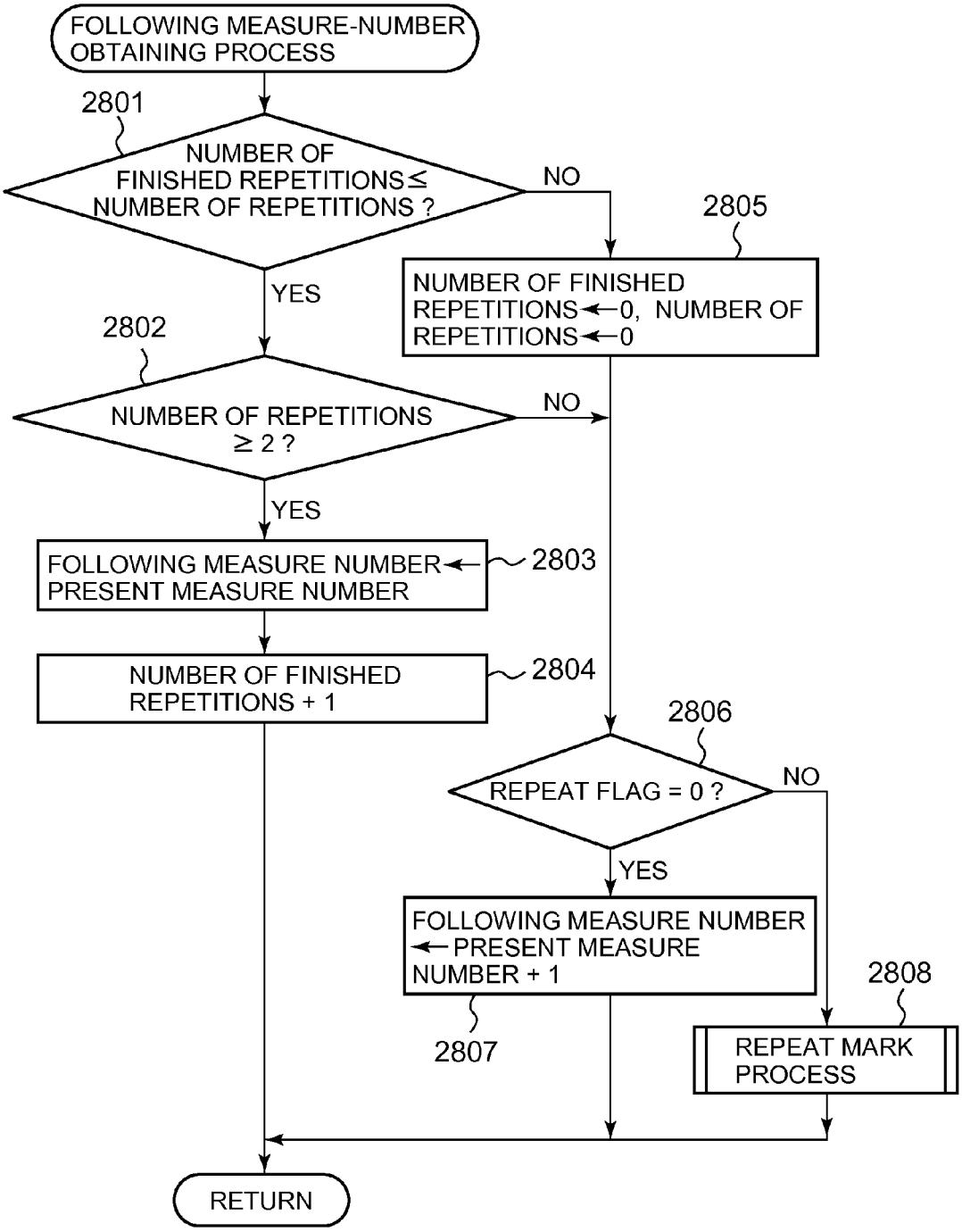
FIG. 28 is a flow chart showing a process at step 2703 in FIG. 27 in more detail.

FIG. 28 is a flow chart showing a process to be performed at step 2703 in FIG. 27 in more detail. CPU 31 judges whether or not the number of finished repetitions stored in RAM 35 is not larger than the number of repetitions (step 2801). When it is determined at step 2801 that the number of finished repetitions stored in RAM 35 is not larger than the number of repetitions, this means that some measures are left to be repeated. Then, CPU 31 judges whether or not the number of repetitions is not less than 2 (step 2802). When it is determined at step 2802 that the number of repetitions is not less than 2, CPU 31 sets the following measure number to the present measure number, and stores the set measure number in RAM 35 (step 2803). Then, CPU 35 increments a parameter in RAM 35, indicating the number of finished repetitions (step 2804). When it is determined at step 2801 that the number of finished repetitions stored in RAM 35 is larger than the number of repetitions, CPU 31 resets a parameter in RAM 35, indicating the number of repetitions to "0" and also the parameter in RAM 35, indicating the number of finished repetitions to "0".

When it is determined at step 2802 that the number of repetitions is less than 2, or after a process at step 2805, CPU 31 judges whether or not the repeat flag has been set to "0" (step 2806). When it is determined YES at step 2806, CPU 31 adds "1" to the present measure number, and stores in RAM 35 the resultant measure number as the following measure number (step 2807). When it is determined NO at step 2806, this case means that the repeat mark is placed. Therefore, CPU 31 performs a repeat mark process (step 2808). The repeat mark process will be described in detail later.

After the process at step 2203 in FIG. 22, CPU 31 judges whether or not the start flag STF has been set to "1" (step 2204). In other words, CPU 31 judges whether or not the musical piece is being played at present (step 2204). When it is determined YES at step 2204, CPU 31 judges whether or not the repeat flag in RAM 35 has been set to "0" and the mute flag in RAM 35 has been set to "0" (step 2205). When the musical piece is being played and an operation is performed on the displayed musical score, it is determined at step 2205 that the operation has given an instruction of muting or repeating a part.

When it is determined YES at step 2205, CPU 31 judges whether or not a parameter indicating the repeat count in RAM 35 has been set to "0" (step 2206). When it is determined YES at step 2206, CPU 31 generates a note-on event of a musical tone sounding now, contained in a data record of the unit music-data file, and sends the generated note-on event to the sound source unit 39 (step 2207). Further, CPU 31 ceases the timer interrupt (step 2208) and resets the start flag STF to "0" (step 2209).

Meanwhile, when it is determined NO at step 2204, at step 2205, or at step 2206, or after the process at step 2209, CPU 31 advances to step 2301 in FIG. 23, and judges whether or not the start flag STF has been set to "1" and the mute flag has been set "1". When it is determined YES at step 2301, CPU 31 generates a note-off event of a musical tone having a pitch and a tone color in a mute part contained in the data record of the unit music-data file, and sends the generated note-off event to the sound source unit 39 (step 2302). The tone color of the part to be muted can be determined based on the position information of the staff to be muted in the musical-score element data file.

CPU 31 judges whether or not the following measure number does not coincide with the present measure number (step 2303). When it is determined at step 2303 that the following measure number does not coincide with the present measure number, CPU 31 obtains the unit music-data file corresponding to the following measure number (step 2304), and further obtains and stores in RAM 35 the data record of the leading address in the obtained unit music-data file (step 2305). Thereafter, CPU 31 releases the timer interrupt (step 2306) and sets the start flag STF to "1" (step 2307).

When it is determined at step 2201 in FIG. 22 that no operation (user's touching operation) has been performed on the area of the musical score displayed on the displaying unit 33 (NO at step 2201 in FIG. 22), CPU 31 judges whether or not the start flag STF has been set to "1" (step 2401 in FIG. 24). When it is determined YES at step 2401, CPU 31 refers to the unit music-data data file to judge whether or not the musical note now sounding is the last note in the measure (step 2402). When it is determined NO at step 2401 or at step 2402, the playing-operation detecting process finishes.

When it is determined YES at step 2402, CPU 31 refers to the unit music-data data file and specifies the following measure number (step 2403). As will be described later, in the case where no repeat mark is placed at the end of the present measure in the musical-score element data file, CPU 31 adds "1" to the present measure number, and stores in RAM 35 the resultant number as the following measure number. In the case where a repeat mark is placed at the end of the present measure in the musical-score element data file, or in the case where a repeat mark is placed at the beginning of the measure corresponding to the following measure, which is obtained by adding "1" to the present measure number (YES at step 2404), CPU 31 performs the repeat mark process at step 2405. When it is determined NO at step 2404, or after the process at step 2405, CPU 31 advances to step 2304 in FIG. 23.

Figure 29:
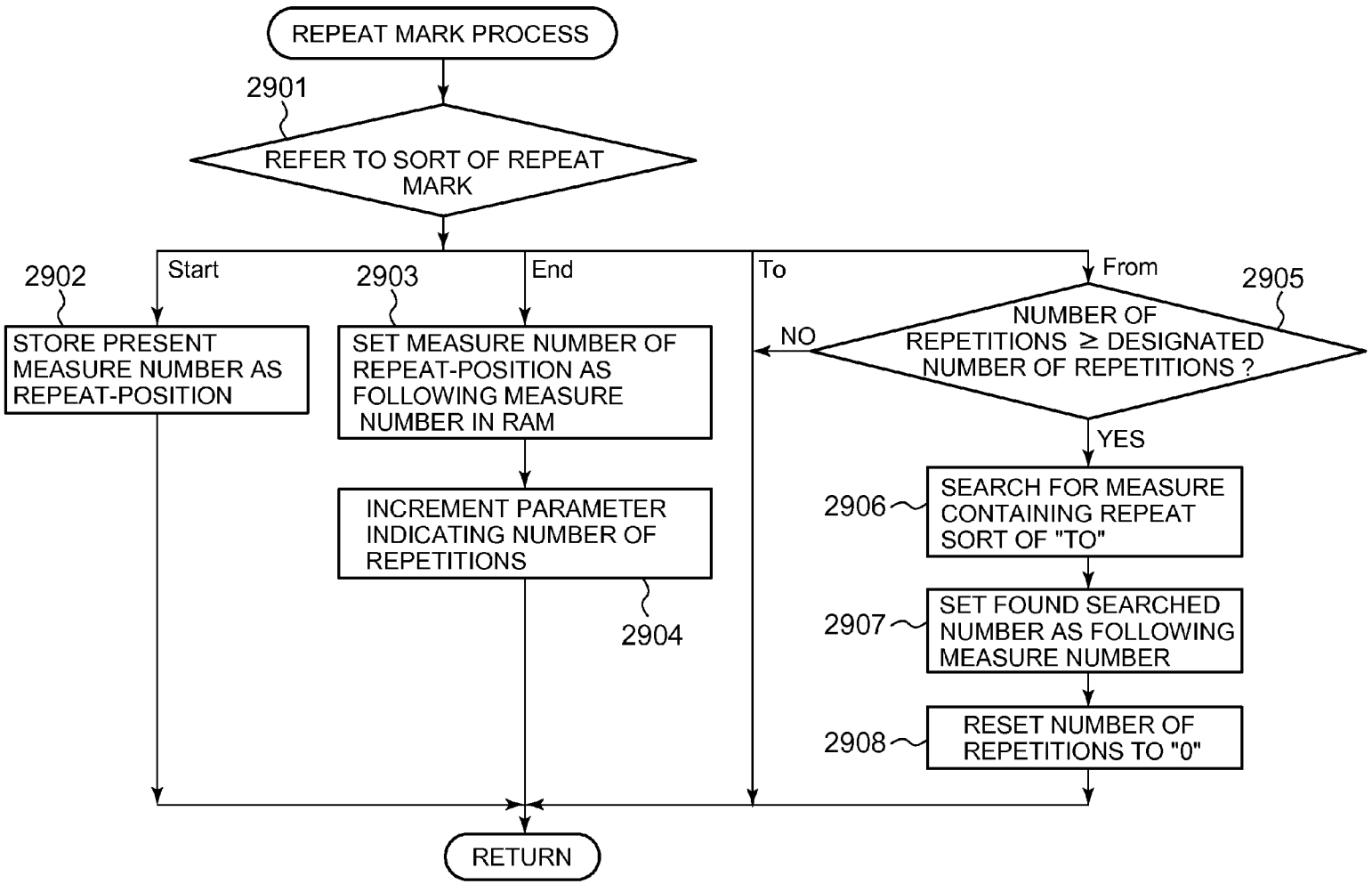
FIG. 29 is a flow chart of an example of a repeat mark process performed in the embodiment of the invention.

FIG. 29 is a flow chart of an example of the repeat mark process performed in the present embodiment of the invention. In the present embodiment of the invention, the repeat marks are separated into two groups, that is, the first group and the second group. The first group contains a left repeat sign, a right repeat sign, and volta brackets (first and second endings), and the second group contains Dal Segno, Da Capo, To Coda, Vide (Coda) and Segno. Every sign in the first and second groups is associated with one of four sorts of the repeat marks, such as "Start", "End", "To", and "From".

For example, the repeat marks in the first group are associated with the following sign sorts.

The left repeat sign: "Start"
The right repeat sign: "End"
Volta brackets (other than final ending): "From"
Volta brackets (final ending): "To"

The repeat marks in the second group are associated with the following sign sorts.

Da Capo: "End"
Dal Segno: "End"
Beginning of music: "Start", only when Da Capo is placed.
Segno: "Start"
Vide: "From"
Coda: "To"

In the musical-score element data file are contained the groups (first or second groups), to which the repeat marks belongs, and the names and the sign sorts of the repeat marks, corresponding to the measure numbers. With respect to the volta brackets (first and second endings), a number corresponding to the number of repetitions is applied to them in addition to the above information.

The repeat mark process is performed with respect to each of groups (first and second groups). Therefore, the repeat mark process is performed with respect to the repeat marks in the first group and also the repeat mark process is performed with respect to the repeat marks in the second group. CPU 31 refers the sort of the repeat mark (step 2901). In the case that the sort of the repeat mark is "Start", CPU 31 stores the present measure number as a repeat-position in RAM 35 (step 2902).

In the case that the sort of the repeat mark is "End", CPU 31 sets the measure number of the repeat-position as the following measure number in RAM 35 (step 2903). CPU 31 increments a parameter indicating the number of repetitions with respect to the repeat mark in RAM 35 (step 2904). In the case that the sort of the repeat mark is "To", the repeat mark process finishes.

In the case that the sort of the repeat mark is "From", CPU 31 judges whether or not the number of repetitions with respect to the repeat mark in RAM 35 is not less than the designated number of repetitions (step 2905). When it is determined at step 2905 that the number of repetitions with respect to the repeat mark is less than the designated number of repetitions, the repeat mark process finishes. When it is determined at step 2905 that the number of repetitions with respect to the repeat mark is not less than the designated number of repetitions, CPU 31 searches through the musical-score element data file for a measure containing the repeat mark indicating the sort of the repeat mark "To" (step 2906). At step 2906, CPU 31 searches for the repeat marks belonging to the same group. CPU 31 sets the measure number of the searched measure as the following measure number in RAM 35 (step 2907). CPU 31 resets the number of repetitions with respect to the repeat mark to "0" (step 2908).

Figure 30:
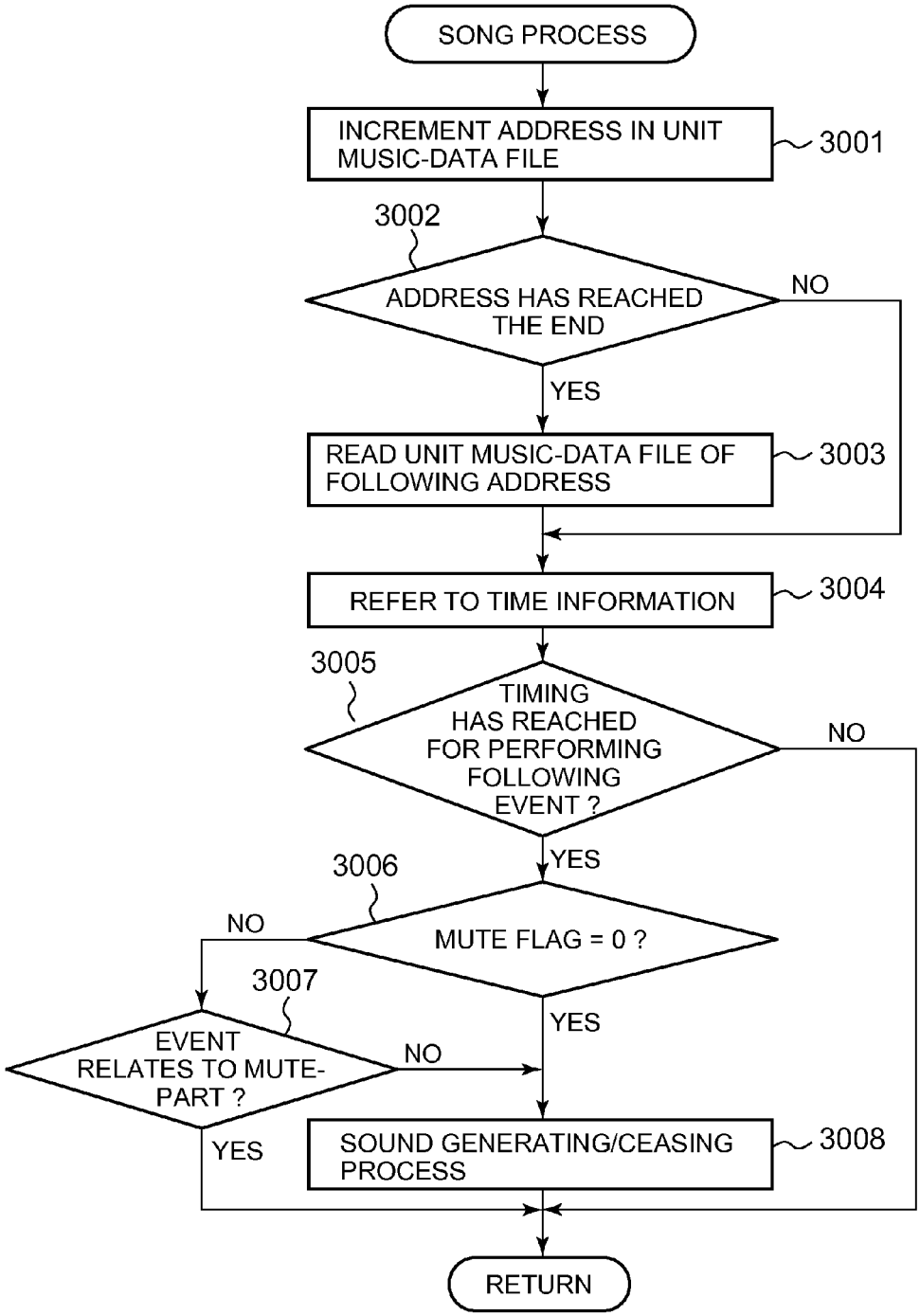
FIG. 30 is a flow chart of an example of a song process performed in the embodiment of the invention.

When the playing operation detecting process has finished at step 1804 in FIG. 18, CPU 31 performs a song process (step 1805). FIG. 30 is a flow chart of an example of the song process performed in the present embodiment of the invention. CPU 31 increments an address in the unit music-data file (step 3001). The address incremented at step 3001 will be an address of a data record indicating a time. CPU 31 judges whether or not the address of the unit music-data file has already reached the end (step 3002). When it is determined YES at step 3002, CPU 31 refers to the following measure number stored in RAM 35 to read the unit music-data file of the following measure number (step 3003).

Thereafter, CPU 31 refers to time information in the data record indicated by the address in the unit music-data file (step 3004), and judges whether or not the present time has reached a timing of performing the following event based on the time information (step 3005). When it is determined YES at step 3005, CPU 31 judges whether or not the mute flag in RAM 35 has been set to "0" (step 3006). When it is determined NO at step 3006, CPU 31 refers to a data record following to the time information, and judges whether or not the event relates to tone color of the mute-part (step 3007). When it is determined YES at step 3007, the song process finishes.

When it is determined YES at step 3006, or when it is determined NO at step 3007, CPU 31 performs a sound generating/ceasing process (step 3008). At step 3008, CPU 31 refers to the data record following to the time information. When the event is a note-on event, CPU 31 generates a note-on event for generating a musical tone of tone color and a pitch indicated by the data record, and sends the note-on event to sound source unit 39. When the event is a note-off event, CPU 31 generates a note-off event for ceasing sounding of a musical tone of tone color and a pitch indicated by the data record, and sends the note-off event to sound source unit 39.

When the song process finishes (step 1805 in FIG. 18), a sound-source sound generating process is performed in the sound source unit 39 (step 1806). In the sound-source sound generating process, receiving the note-on event from CPU 31, the sound source 39 refers to the pitch and tone color contained in the note-on event and reads waveform data of the tone color from ROM 34 at a rate conforming to the pitch, thereby generating musical tone data. Receiving the note-off event from CPU 31, the sound source 39 ceases sounding of a musical tone of tone color and pitch indicated by the note-off event.

When the sound-source sound generating process finishes (step 1806), CPU 31 performs other process at step 1807 and returns to step 1802. In the other process (step 1807) are included a process for sending and/or receiving data from the center apparatus 10 through the communication I/F 37, a process of reading data from an external storing medium (not shown) such as a memory card, and a process of writing data into the external storing medium.

Figure 32:
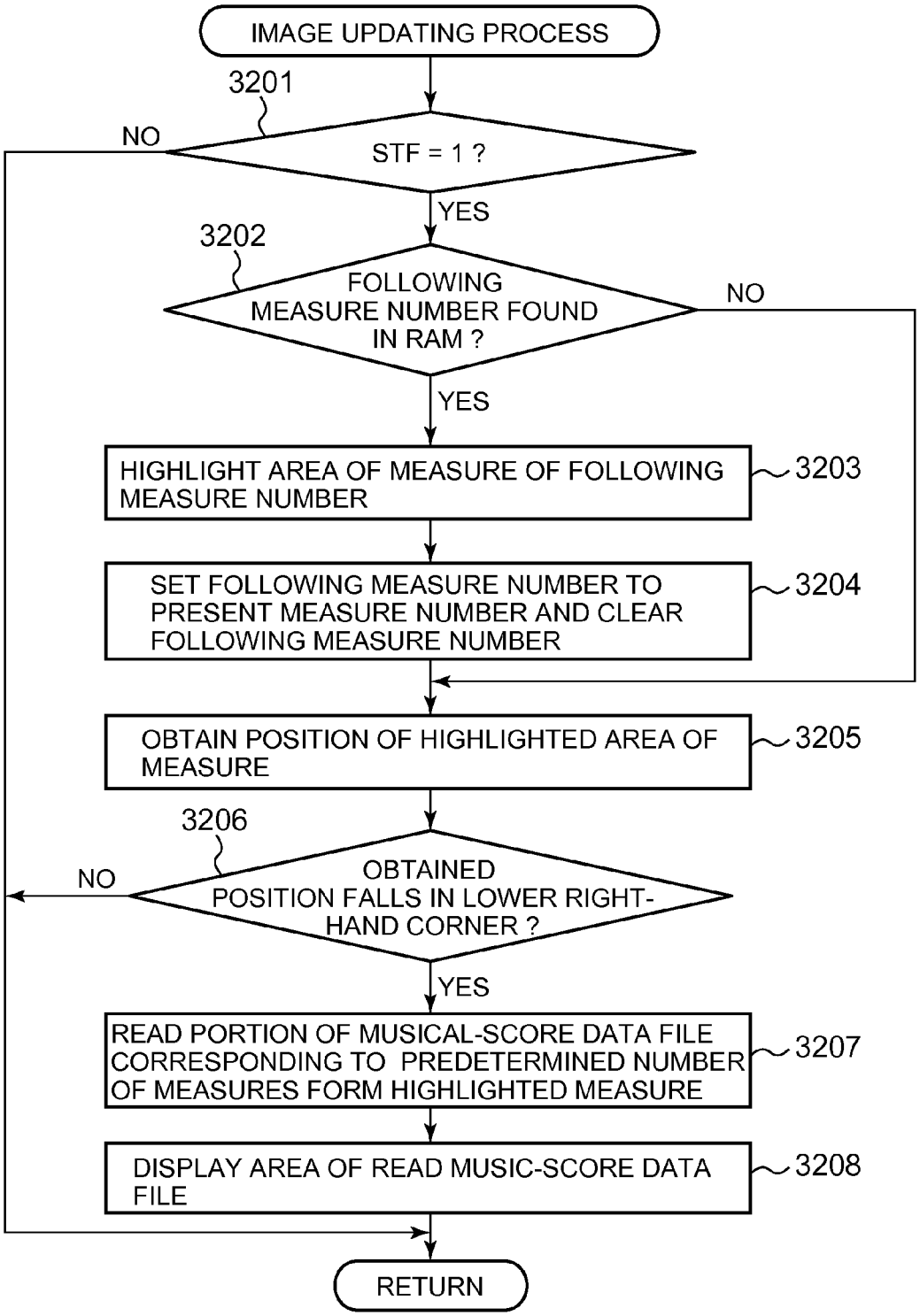
FIG. 32 is a flow chart of an example of an image updating process performed in the embodiment of the invention.

The image updating process of step 1803 in FIG. 18 will be described, again. FIG. 32 is a flowchart of an example of the image updating process performed in the present embodiment of the invention. CPU 31 judges whether or not the start flag STF has been set to "1" (step 3201). When it is determined NO at step 3201, the image updating process finishes. When it is determined YES at step 3201, CPU 31 judges whether or not the following measure number has been found in RAM 35 (step 3202). When it is determined YES at step 3202, CPU 31 highlights the area of the measure corresponding to the following measure number (step 3203). Thereafter, CPU 31 sets the following measure number to the present measure number in RAM 35, and clears the following measure number (step 3204).

CPU 31 obtains the position of the highlighted area of the measure (step 3205), and judges whether or not the obtained position falls within the lower right-hand corner of the image (step 3206). At step 3206, it is judged whether or not the measure, which is being played, is in the lower right-hand corner of the image. When it is determined YES at step 3206, CPU 31 reads a portion of the musical-score data file corresponding to the predetermined number of measures from the measure highlighted at present (step 3207). Then, CPU 31 displays the read area of the musical-score data file on the display screen of the displaying unit 33 (step 3208).

In the embodiment of the invention, the musical-score element extracting unit 42 specifies areas of measures and measure numbers on the musical score in the image data file based on the positions of the part lines, staffs and bar lines composing the elements of the musical score. The music-data dividing unit 44 divides the music-data file based on the time information in the music-data file into plural unit music-data files each containing pitch information and time information with respect to each measure. Further, the music-data dividing unit 44 specifies measures, in which a repeat mark is placed, based on the sorts and positions of the repeat marks and the positions of the part lines, staff and bar lines on the musical score in the image data file, and removes overlapping unit music-data files from the plural unit music-data files, thereby obtaining final unit music-data files with the overlapping files removed and storing the final unit music-data files associated with the corresponding measure numbers in RAM 35. As a result, the unit music-data files corresponding respectively to the measures on the musical score can be generated in the present embodiment of the invention.

In the present embodiment of the invention, the user is allowed to reproduce data from the position that he or she wants to reproduce, with use of the image data file, the unit music-data files, and the musical-score element data file. The terminal apparatus 30 has the displaying unit 33 for displaying the image of the musical score based on the image data and the touch panel for detecting a position where the user touches, which panel is disposed on top of the displaying unit 33. CPU 31 reads the unit music-data file, and gives a musical-tone generating unit an instruction of generating a musical tone based on the music data. In particular, CPU 31 refers to the musical-score element data file to specify a position corresponding to the detected position on the displayed musical score, and gives the musical-tone generating unit an instruction of generating a musical tone, based on the music data in the unit music-data file corresponding to the position specified in the musical score. Therefore, the user can reproduce a musical piece in his or her desired measures by designating his or her desired position on the musical score displayed on the displaying unit 33.

In the present embodiment of the invention, the musical-score element data file contains sorts and positions of repeat marks in the musical score, and the overlapping files due to repletion are removed from the plural unit music-data files, based on the sorts and positions of the musical-score composing elements such as repeat marks. Therefore, it is possible to display the musical score containing repeat marks, allowing the user to designate a unit music-data file by specifying a position on the displayed musical score.

In the present embodiment of the invention, after having given an instruction of generating a musical tone based on the music data in the unit music-data file, CPU 31 reads the unit music-data file corresponding to the following measure, and gives the musical-tone generating unit an instruction of generating a musical tone based on the music data in the read unit music-data file, whereby a musical piece can be reproduced from the measure corresponding to the position designated on the musical score.

In the embodiment of the invention, CPU 31 detects the number of times touching operation is performed on the touch panel 32, and specifies touched positions and the number of touching operations on the displayed musical score. CPU 31 repeatedly gives an instruction of generating a musical tone based on the music data in the unit music-data file corresponding to the positions touched on the musical score by the number of touch operations, whereby a musical piece in the designated measures can be repeatedly reproduced by the number of repetitions desired by the user.

In the embodiment of the invention, after having repeatedly given an instruction of generating a musical tone based on the music data in the unit music-data file by the number of operations, CPU 31 reads the unit music-data file corresponding to the following measure, and gives the musical-tone generating unit an instruction of generating a musical tone based on the music data in the read unit music-data file, whereby after a musical piece in the predetermined measures is repeatedly reproduced by the predetermined number of repetitions, a musical piece in the subsequent measures can be reproduced.

The invention is not limited to the particular embodiments described above. For example, in the embodiment of the invention, the center apparatus 10 generates the displaying musical-score data file, the musical-score element data file, and unit music-data files, and transfers the generated files to the terminal apparatus 30, and the terminal apparatus 30 displays the received files on the display screen of the displaying unit 33 and refers to the musical-score element data file, thereby reproducing a musical piece based on the unit music-data files. But a modification may be made such that the center apparatus 10 refers to the musical-score element data file and reproduces the musical piece based on the unit music-data files with use of the sound system 18 including the sound source unit 19. In a similar manner, the center apparatus 10 may be arranged so as to display the musical score based on the musical-score data file, allowing the user to designate a measure on the displayed musical score.

Although specific embodiments of the present invention have been described in the foregoing detailed description, it will be understood that the invention is not limited to the particular embodiments described herein, but numerous rearrangements, modifications, and substitutions may be made to the embodiments of the invention without departing from the scope of the invention. The following claims are intended to encompass all such modifications.

What is claimed is:

1. A musical-score information generating apparatus comprising:

a storing unit for storing music data and image data, wherein the music data contains pitch information for indicating a pitch of each of musical tones composing a musical piece and the time information for indicating a timing of generation of each musical tone in the musical piece, and the image data represents an image of a musical score of the musical piece, the musical score having musical-score composing elements such as part lines, staffs, and bar lines;

a measure specifying unit for specifying an area of each measure and the measure number of the measure based on positions of the part lines, the staffs and the bar lines on the musical score;

a unit music-data generating unit for dividing the music data based on the time information in the music data to generate plural pieces of unit music data each containing time information and pitch information for one measure;

a repeat-mark position specifying unit for specifying a measure where a repeat mark is placed, based on a sort and a position of the repeat mark and the positions of the part lines, the staffs and the bar lines on the musical score;

a unit music-data obtaining unit for removing overlapping unit music data form the plural pieces of unit music data generated by the unit music-data generating unit to obtain a final pieces of unit music data, and for associating the obtained final pieces of unit music data with the measure numbers respectively to store said final pieces of unit music data in the storing unit; and a musical-score element data generating unit for generating musical-score element data containing positions on the musical score where the part lines, the staffs and the bar lines are placed, and areas and the measure numbers of the measures, and sorts and positions of the repeats marks, and storing the generated musical-score element data in the storing unit.

2. The musical-score information generating apparatus according to claim 1, further comprising:

a position detecting unit for detecting from the image data, positions on the musical score where the part lines, the staffs and the bar lines are placed.

3. The musical-score information generating apparatus according to claim 2, wherein the position detecting unit detects a pixel group corresponding to a vertical line in an area of the left end on the musical score and detects a position of the part line based on the detected pixel group.

4. The musical-score information generating apparatus according to claim 2, wherein the position detecting unit counts the number of pixels corresponding to black points aligned in the horizontal direction in an area where the part line is placed in the vertical direction and specifies lines composing the staff based on the counted number of pixels, thereby detecting a position where the staff is placed.

5. The musical-score information generating apparatus according to claim 2, wherein the position detecting unit detects a pixel group corresponding to a vertical line placed to the right of the part line on the musical score in an area where the part line is placed in the vertical direction and detects a position of the bar line based on the detected pixel group.

6. The musical-score information generating apparatus according to claim 1, further comprising:

a repeat mark detecting unit for detecting a sort and a position of the repeat mark from the image data.

7. The musical-score information generating apparatus according to claim 1, wherein the unit music-data obtaining unit comprises:

a measure-number calculating unit for calculating the measure numbers corresponding respectively to the plural pieces of unit music data; and a removing unit for judging whether or not unit music data having the calculated measure number is found among the plural pieces of unit music data generated by the unit music-data generating unit, and for removing the unit music data having the calculated measure number from the plural pieces of unit music data, when the unit music data having the calculated measure number is found.

8. The musical-score information generating apparatus according to claim 1, further comprising:

a symbol drawing unit for drawing a symbol corresponding to the specified sort of the repeat mark at the specified position of the repeat mark, wherein the unit music-data obtaining unit specifies a measure, in which the symbol drawn by the symbol drawing unit is placed, based on the positions of the part lines, the staffs and the bar lines on the musical score, and the drawn symbol and the position of the drawn symbol.

9. The musical-score information generating apparatus according to claim 1, wherein the repeat-mark position specifying unit comprises:

a calculating unit for calculating a correlation value between an image of each of areas in the image data of the musical score and an image of the repeat mark to be specified;

a maximum-correlation area detecting unit for detecting the area showing the maximum correlation value calculated by the calculating unit;

an area specifying unit for calculating a correlation value between an image of the area detected by the maximum-correlation area detecting unit and the image of each of the areas in the image data of the musical score and specifies an area showing the calculated correlation value that is larger than a predetermined threshold value, and the repeat mark position specifying unit sets a position of the area specified by the area specifying unit in the image data of the musical score as a position of the repeat mark to be specified.

10. A musical-tone generation controlling apparatus comprising:

a musical-tone generating unit for generating musical tones composing music;

a storing unit for storing image data of a musical score of music, plural pieces of unit music data containing music data, and musical-score element data, wherein the music data contains pitch information indicating a pitch of each of musical tones in a measure and time information indicating a timing of generation of each of musical tones in the measure, and the musical-score element data contains positions of part lines, staffs and bar lines on the musical score, and an area of each of measures and the measure numbers of the measures;

a displaying unit for displaying an image of the musical score based on the image data representing the musical score of music;

a position detecting unit disposed on top of the displaying unit for detecting a position on the displaying unit where an operation is performed by a user;

a position specifying unit for specifying a position on the displayed musical score corresponding to the position detected by the position detecting unit with reference to the musical-score element data stored in the storing unit; and a tone-generation controlling unit for reading from the storing unit a final unit music data corresponding to the position specified on the displayed musical score by the position specifying unit, and for instructing the musical-tone generating unit to generate a musical tone based on music data in the final unit music data read from the storing unit.

11. The musical-tone generation controlling apparatus according to claim 10, wherein the tone-generation controlling unit reads unit music data corresponding to a measure following to the final unit music data from the storing unit, after having instructed the musical-tone generating unit to generate a musical tone based on the music data in the final unit music data, and instructs the musical-tone generating unit to generate a musical tone based on music data in the unit music data read from the storing unit.

12. The musical-tone generation controlling apparatus according to claim 10, wherein the position specifying unit detects a position and the number of times an operation is performed on the displaying unit by a user and specifies a position and the number of times the operation is performed on the musical score displayed on the displaying unit based on the detected position on the displayed musical score and the detected number of performed operations, and the tone-generation controlling unit repeatedly instructs by the detected number of performed operations, the musical-tone generating unit to generate a musical tone based on the music data in the final unit music data corresponding to the position specified on the displayed musical score by the position specifying unit.

13. The musical-tone generation controlling apparatus according to claim 12, wherein the tone-generation controlling unit reads unit music data corresponding to a measure following to the final unit music data from the storing unit, after repeatedly instructing by the number of performed operations, the musical-tone generating unit to generate a musical tone based on the music data in the unit music data, and instructs the musical-tone generating unit to generate a musical tone based on music data in the unit music data read from the storing unit.

14. A musical-tone generation controlling apparatus comprising:

a musical-tone generating unit for generating musical tones composing music;

a storing unit for storing plural pieces of unit music data and musical-score element data, wherein the plural pieces of unit music data contain music data including the measure number of each of measures, pitch information indicating a pitch of each musical note in each measure, and time information indicating a timing of generation of each musical note in each measure, and the musical-score element data contains the measure numbers and sorts of repeat marks placed in the measures, and further wherein the plural pieces of unit music data include no overlapping unit music data, which is to be repeated based on the sorts and positions of the repeat marks composing the musical score elements;

a tone-generation controlling unit for detecting the repeat mark placed in the unit music data containing a musical tone to be generated, with reference to the musical-score element data stored in the storing unit, to determine unit music data to read next based on the detected repeat mark, and for reading the determined unit music data from the storing unit to give the musical-tone generating unit an instruction to generate a musical tone based on music data in the unit music data read from the storing unit.

15. The musical-tone generation controlling apparatus according to claim 14, wherein a left repeat mark and a right repeat mark are included in the sorts of the repeat mark, and the tone-generation controlling unit stores in the storing unit the measure number of the unit music data as a position to be repeated in the unit music data, in the case where the left repeat mark is included as the repeat mark in the musical-score element data, and determines unit music data to read next, based on the measure number stored in the storing unit as the position to be repeated, in the case where the right repeat mark is included as the repeat mark in the musical-score element data.

16. The musical-tone generation controlling apparatus according to claim 14, wherein brackets bearing a number are included in the sorts of the repeat mark, and the tone-generation controlling unit determines unit music data to read next, in accordance with the measure number set as the position to be repeated, in the case where the bracket bearing a number is included as the repeat mark in the musical-score element data and the number of the bracket is less than the designated number of repetitions, and determines the unit music data to read next, based on the measure number included in the musical-score element data and indicating the position to back to, in the case where the number of the bracket is not less than the designated number of repetitions.

17. In a musical-score information generating apparatus having a storing unit for storing music data and image data, wherein the music data contains pitch information for indicating a pitch of each of musical tones composing a musical piece and the time information for indicating a timing of generation of each musical tone in the musical piece, and the image data represents an image of a musical score of the musical piece, the musical score having musical-score composing elements such as part lines, staffs, and bar lines, a musical-score information generating method comprising:

a step of specifying an area of each measure and the measure number of the measure based on positions of the part lines, the staffs and the bar lines on the musical score;

a step of dividing the music data based on the time information in the music data to generate plural pieces of unit music data each containing time information and pitch information for one measure;

a step of specifying a measure where a repeat mark is placed, based on a sort and a position of the repeat mark and the positions of the part lines, the staffs and the bar lines on the musical score;

a step of removing overlapping unit music data form the plural pieces of unit music data to obtain a final pieces of unit music data, and associating the obtained final pieces of unit music data with the measure numbers respectively to store said final pieces of unit music data in the storing unit; and a step of generating musical-score element data containing positions on the musical score where the part lines, the staffs and the bar lines are placed, and areas and the measure numbers of the measures, and sorts and positions of the repeats marks, and storing the generated musical-score element data in the storing unit.

18. In a musical-tone generation controlling apparatus having a musical-tone generating unit for generating musical tones composing music; a storing unit for storing image data of a musical score of music, plural pieces of unit music data containing music data, and musical-score element data, wherein the music data contains pitch information indicating a pitch of each of musical tones in a measure and time information indicating a timing of generation of each of musical tones in the measure, and the musical-score element data contains positions of part lines, staffs and bar lines on the musical score, and an area of each of measures and the measure numbers of the measures; a displaying unit for displaying an image of the musical score based on the image data representing the musical score of music; a position detecting unit disposed on top of the displaying unit for detecting a position on the displaying unit where an operation is performed by a user, a musical-tone generation controlling method comprising:

a step of specifying a position on the displayed musical score corresponding to the position detected by the position detecting unit with reference to the musical-score element data stored in the storing unit; and a step of reading from the storing unit a final unit music data corresponding to the position specified on the displayed musical score, and instructing the musical-tone generating unit to generate a musical tone based on music data in the final unit music data read from the storing unit.

19. In a musical-tone generation controlling apparatus having a musical-tone generating unit for generating musical tones composing music; a storing unit for storing plural pieces of unit music data and musical-score element data, wherein the plural pieces of unit music data contain music data including the measure number of each of measures, pitch information indicating a pitch of each musical note in each measure, and time information indicating a timing of generation of each musical note in each measure, and the musical-score element data contains the measure numbers and sorts of repeat marks placed in the measures, and further wherein the plural pieces of unit music data include no overlapping unit music data, which is to be repeated based on the sorts and positions of the repeat marks composing the musical score elements, a musical-tone generation controlling method comprising:

a step of detecting the repeat mark placed in the unit music data containing a musical tone to be generated, with reference to the musical-score element data stored in the storing unit, and determining unit music data to read next based on the detected repeat mark; and a step of reading the determined unit music data from the storing unit, and instructing the musical-tone generating unit to generate a musical tone based on music data in the unit music data read from the storing unit.

* * * * *